US009280106B2

(12) United States Patent
Murakami

(10) Patent No.: US 9,280,106 B2
(45) Date of Patent: Mar. 8, 2016

(54) FUSER DEVICE AND IMAGE FORMING APPARATUS

(71) Applicant: Oki Data Corporation, Tokyo (JP)

(72) Inventor: Tatsuya Murakami, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/048,733

(22) Filed: Oct. 8, 2013

(65) Prior Publication Data

US 2014/0099147 A1 Apr. 10, 2014

(30) Foreign Application Priority Data

Oct. 9, 2012 (JP) ..... 2012-224123

(51) Int. Cl.
*G03G 15/20* (2006.01)

(52) U.S. Cl.
CPC .... *G03G 15/2053* (2013.01); *G03G 2215/2025* (2013.01)

(58) Field of Classification Search
CPC ..... G03G 2215/2025
See application file for complete search history.

(56) References Cited

U.S. PATENT DOCUMENTS

| | | | | |
|---|---|---|---|---|
| 9,014,610 | B2 * | 4/2015 | Murakami | G03G 15/2085 399/328 |
| 2004/0120740 | A1 * | 6/2004 | Uekawa et al. | 399/329 |
| 2005/0129431 | A1 * | 6/2005 | Oohara | G03G 15/2028 399/329 |
| 2008/0003028 | A1 * | 1/2008 | Kuroki | G03G 15/2053 399/329 |
| 2008/0003029 | A1 * | 1/2008 | Fujimori | G03G 15/2053 399/329 |
| 2008/0317525 | A1 * | 12/2008 | Kuroki | G03G 15/2053 399/329 |
| 2008/0317526 | A1 * | 12/2008 | Fujimori | G03G 15/2053 399/329 |
| 2010/0054827 | A1 * | 3/2010 | Carr et al. | 399/329 |
| 2010/0239337 | A1 * | 9/2010 | Muramatsu | G03G 15/2064 399/329 |
| 2013/0045032 | A1 * | 2/2013 | Shimokawa et al. | 399/329 |
| 2013/0164056 | A1 * | 6/2013 | Imada et al. | 399/329 |
| 2014/0064787 | A1 * | 3/2014 | Mogi | 399/122 |
| 2014/0064788 | A1 * | 3/2014 | Mogi | 399/122 |
| 2014/0199089 | A1 * | 7/2014 | Ishikawa | G03G 15/1605 399/45 |
| 2014/0294460 | A1 * | 10/2014 | Kondo | G03G 15/206 399/329 |
| 2014/0301760 | A1 * | 10/2014 | Nanjo et al. | 399/329 |
| 2014/0356015 | A1 * | 12/2014 | Kawai | 399/94 |
| 2015/0030361 | A1 * | 1/2015 | Murakami | G03G 15/2053 399/329 |
| 2015/0117881 | A1 * | 4/2015 | Murakami | G03G 15/2039 399/33 |

FOREIGN PATENT DOCUMENTS

| | | |
|---|---|---|
| JP | H05-208750 A | 8/1993 |
| JP | 2004145368 A | 5/2004 |
| JP | 2006259039 A | 9/2006 |
| JP | 2009-151115 A | 7/2009 |
| JP | 2010-256714 A | 11/2010 |

* cited by examiner

*Primary Examiner* — David Gray
*Assistant Examiner* — Geoffrey Evans
(74) *Attorney, Agent, or Firm* — Muncy, Geissler, Olds & Lowe, P.C.

(57) ABSTRACT

A fuser device includes a belt part rotating in a tension free state to carry a medium in a medium carrying direction, a first nip forming part arranged inside the belt part, a second nip forming part arranged outside the belt part sandwiching the belt part with the first nip forming part so that a nip area is formed therebetween, and a regulation member regulating a movement of the belt in a width direction of the belt part. The regulation member is configured with a belt regulation part and a slant part. The belt regulation part has a flat shape arranged near one of side edges of the belt part along the nip area with a predetermined gap (W6). The slant part extends from an edge of the belt regulation part.

17 Claims, 19 Drawing Sheets

FUSER DEVICE AND IMAGE FORMING APPARATUS

CROSS REFERENCE TO RELATED APPLICATION

The present application is related to, claims priority from and incorporates by reference Japanese Patent Application No. 2012-224123, filed on Oct. 9, 2012.

TECHNICAL FIELD

This invention relates to a fuser device and an image forming apparatus with the fuser, the image forming apparatus being such as a photocopy machine, a facsimile, a printer, a multifunction machine, and the like.

BACKGROUND

Conventionally, there is a fuser device that has a configuration wherein a nip area is formed by a fuser belt and fusion of a record medium is performed when it goes through the nip area (for example, refer to JP Laid-Open Patent Application 2009-151115).

However, in the fuser device having the above-described configuration, the belt twists in a width direction of the fuser belt at the nip area, and this may cause unfavorable effects to fusion function.

SUMMARY

A fuser device disclosed in the application for fusing a developer image on a medium by applying heat and pressure includes: a belt part that has an endless shape and that is configured to rotate in a tension free state to carry the medium in a medium carrying direction; a first nip forming part that is arranged inside the belt part; a second nip forming part that is arranged outside the belt part to face the first nip forming part, and configured to apply a pressure toward the first nip forming part, sandwiching the belt part with the first nip forming part so that a nip area is formed therebetween, the developer image on the medium being fused during passing the nip area; and a regulation member that regulates a movement of the belt in a width direction of the belt part. The regulation member is configured with a belt regulation part and a slant part, the belt regulation part has a flat shape that is arranged near one of side edges of the belt part along the nip area with a predetermined gap (W6). The slant part extends from an edge of the belt regulation part.

According to the present invention, the belt twist in the width direction at the nip area is prevented. Further, by this prevention, the fuser belt is' prevented from being damaged.

BRIEF DESCRIPTIONS OF THE DRAWINGS

Figure 3:
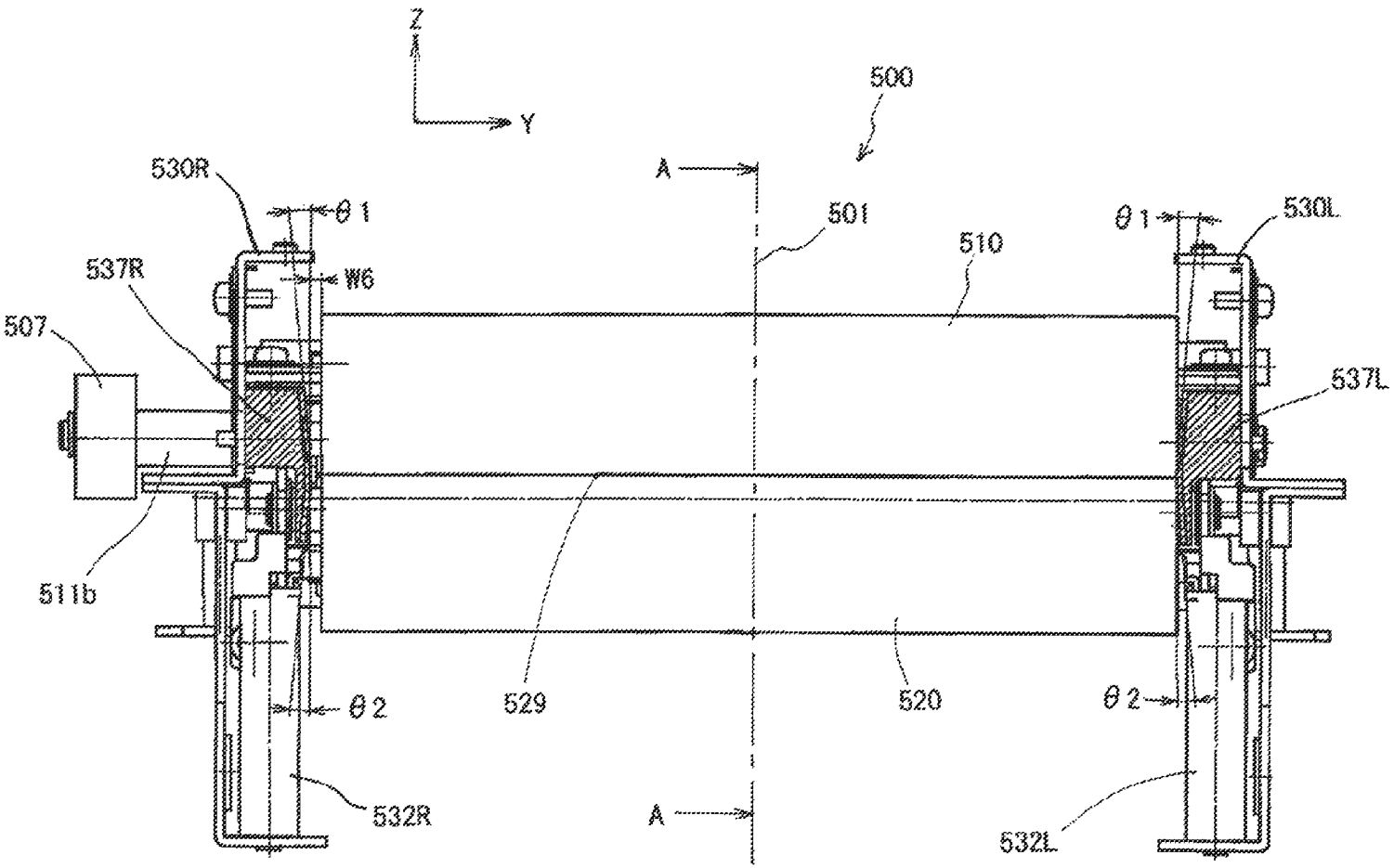
FIG. 3 is a front view of the fuser unit viewed from the x-axis plus side in FIG. 2.
Figure 10C:
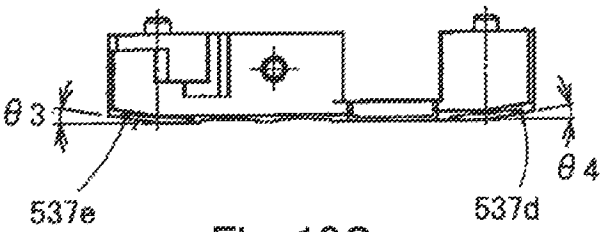
Figure 10A:
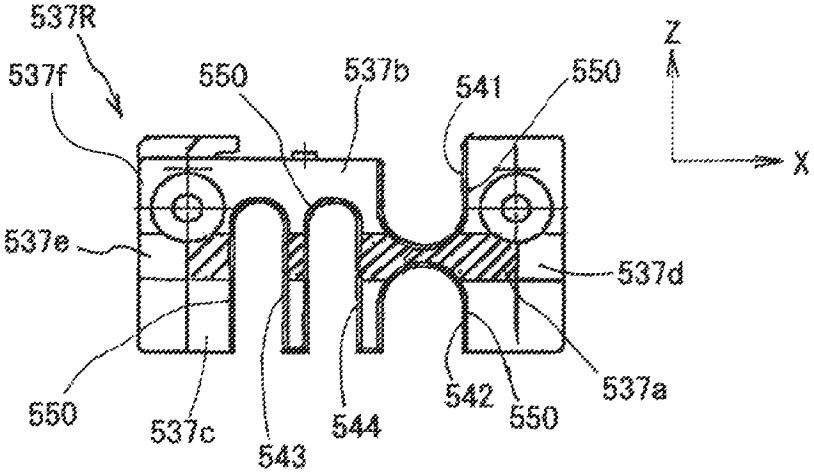
Figure 10B:
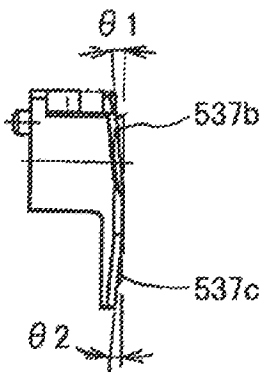

FIGS. 10A, 10B, and 10C are configuration views illustrating the form of a belt guide in FIG. 3. FIG. 10A is a front view thereof, FIG. 10B is a left side view thereof, and FIG. 10C is a top view thereof.

Figures 11A, 11B:
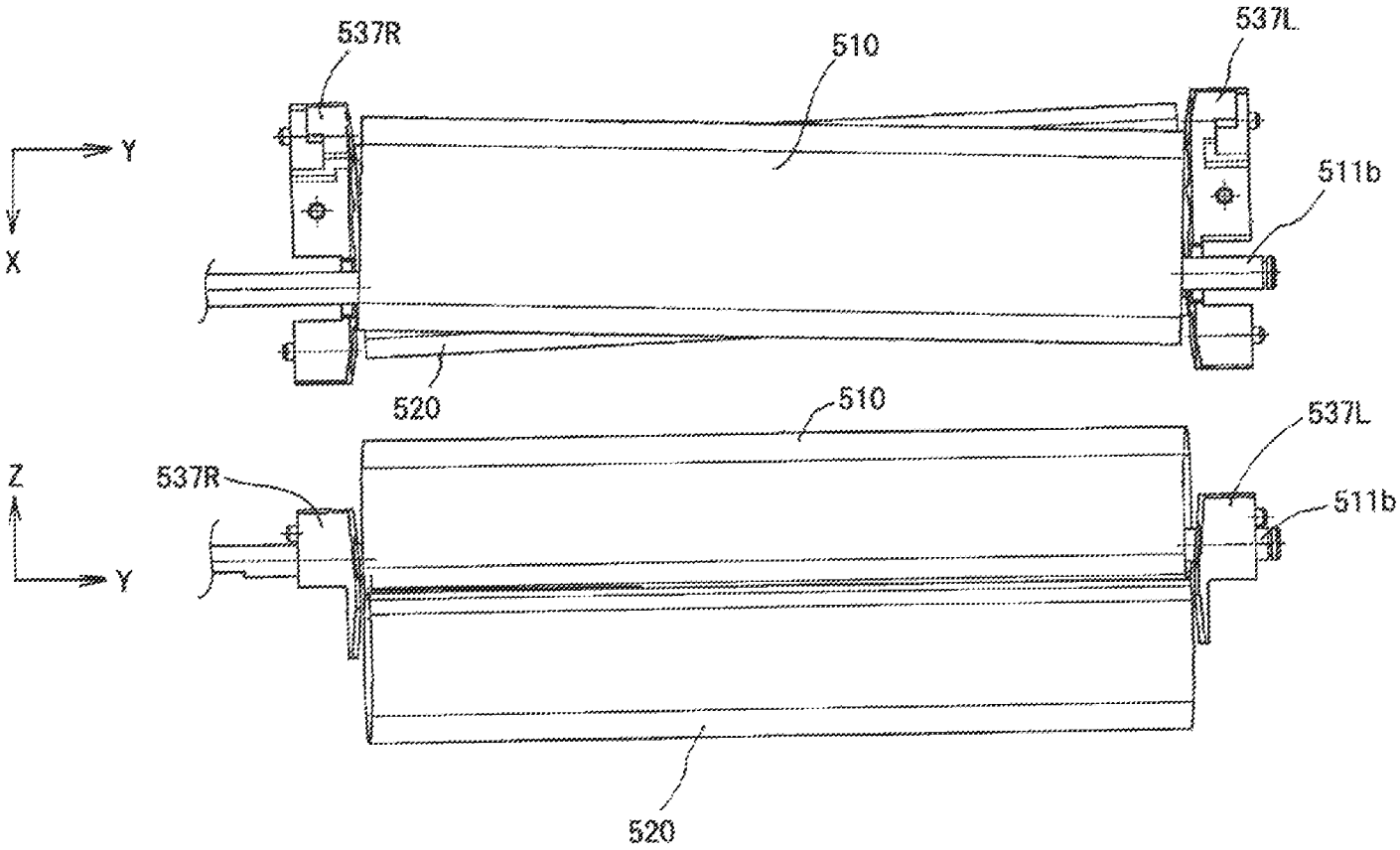

FIGS. 11A and 11B are explanatory views illustrating the positional relation of a drive roller, right and left belt guides, the fuser belt, and the pressure application belt when the fuser unit is assembled in the first embodiment. FIG. 11A is a front view thereof, and FIG. 11B is a top view thereof.

Figure 12A:
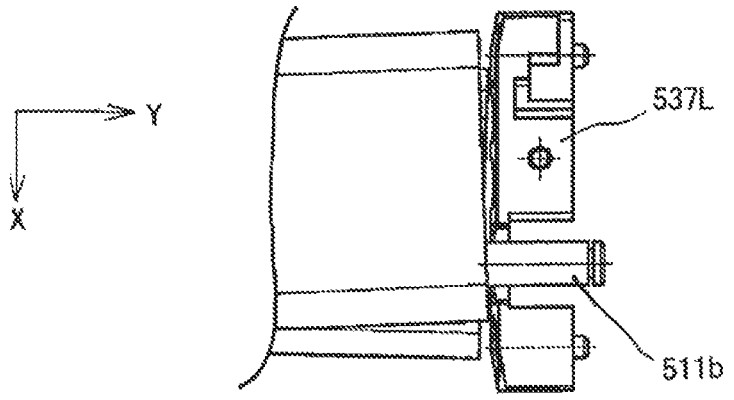
Figure 12B:
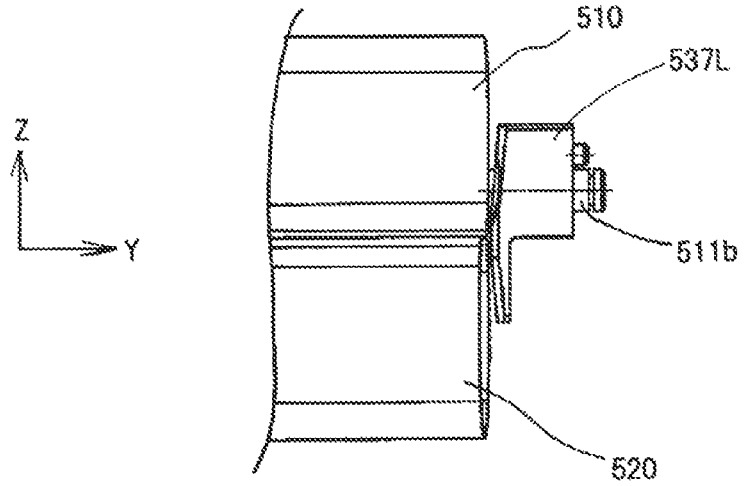

FIGS. 12A and 12B are movement explanatory views to explain the movement of the fuser belt and the pressure application belt at an activation time when the rotation of the drive roller is started. FIG. 12A is a front view thereof, and FIG. 12B is a top view thereof.

Figure 13A:
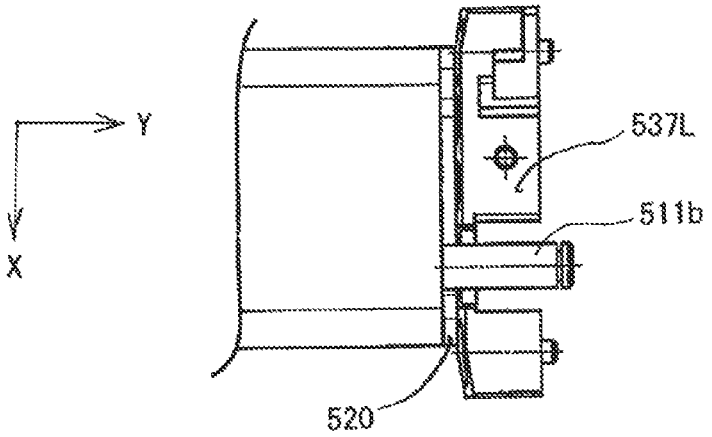
Figure 13B:
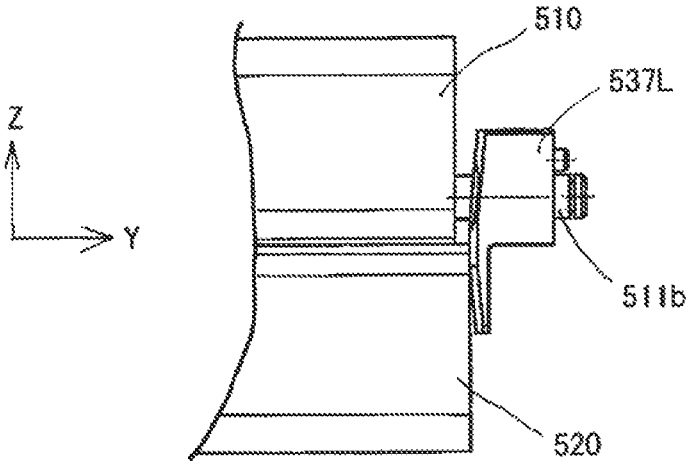

FIGS. 13A and 13B are movement explanatory views to explain the movement of the fuser belt and the pressure application belt at the activation time when the rotation of the drive roller is started. FIG. 13A is a front view thereof, and FIG. 13B is a top view thereof.

Figure 14A:
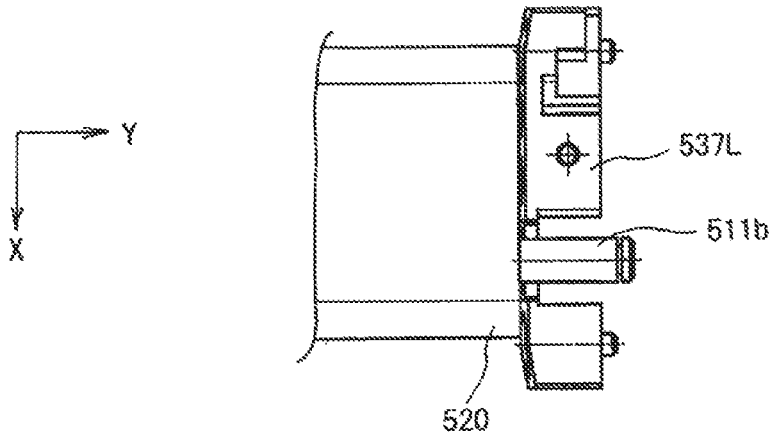
Figure 14B:
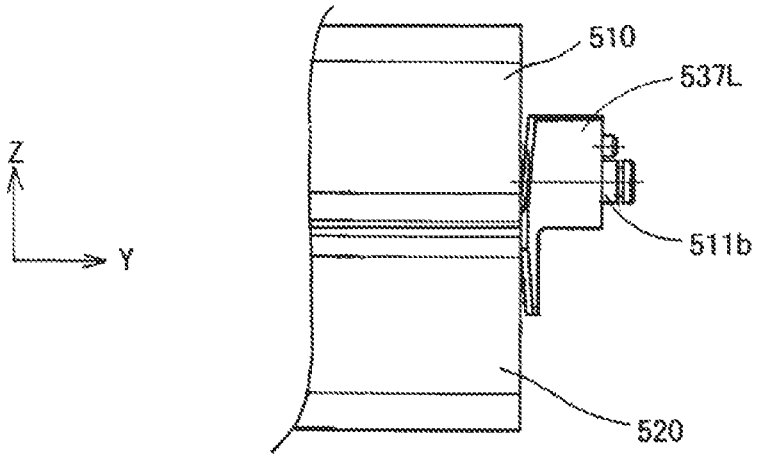

FIGS. 14A and 14B are movement explanatory views to explain the movement of the fuser belt and the pressure application belt at the activation time when the rotation of the drive roller is started. FIG. 14A is a front view thereof, and FIG. 14B is a top view thereof.

Figure 15C:
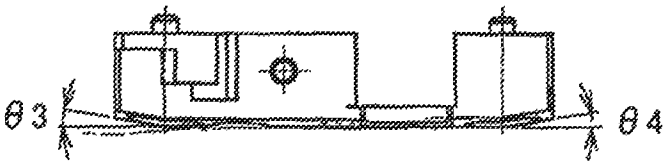
Figure 15A:
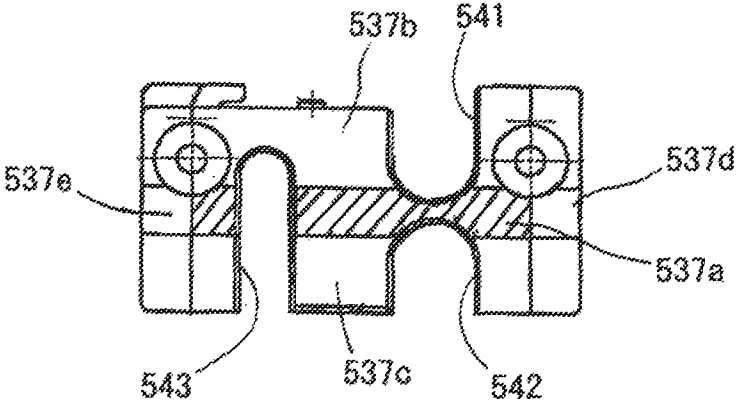
Figure 15B:
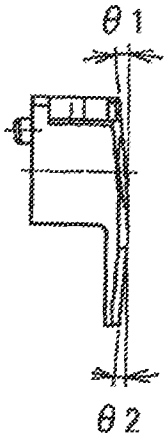

FIGS. 15A, 15B, and 15C are configuration views illustrating an example of another form of the belt guide in the first embodiment. FIG. 15A is a front view thereof, FIG. 15B is a left side view thereof, and FIG. 15C is a top view thereof.

Figure 2:
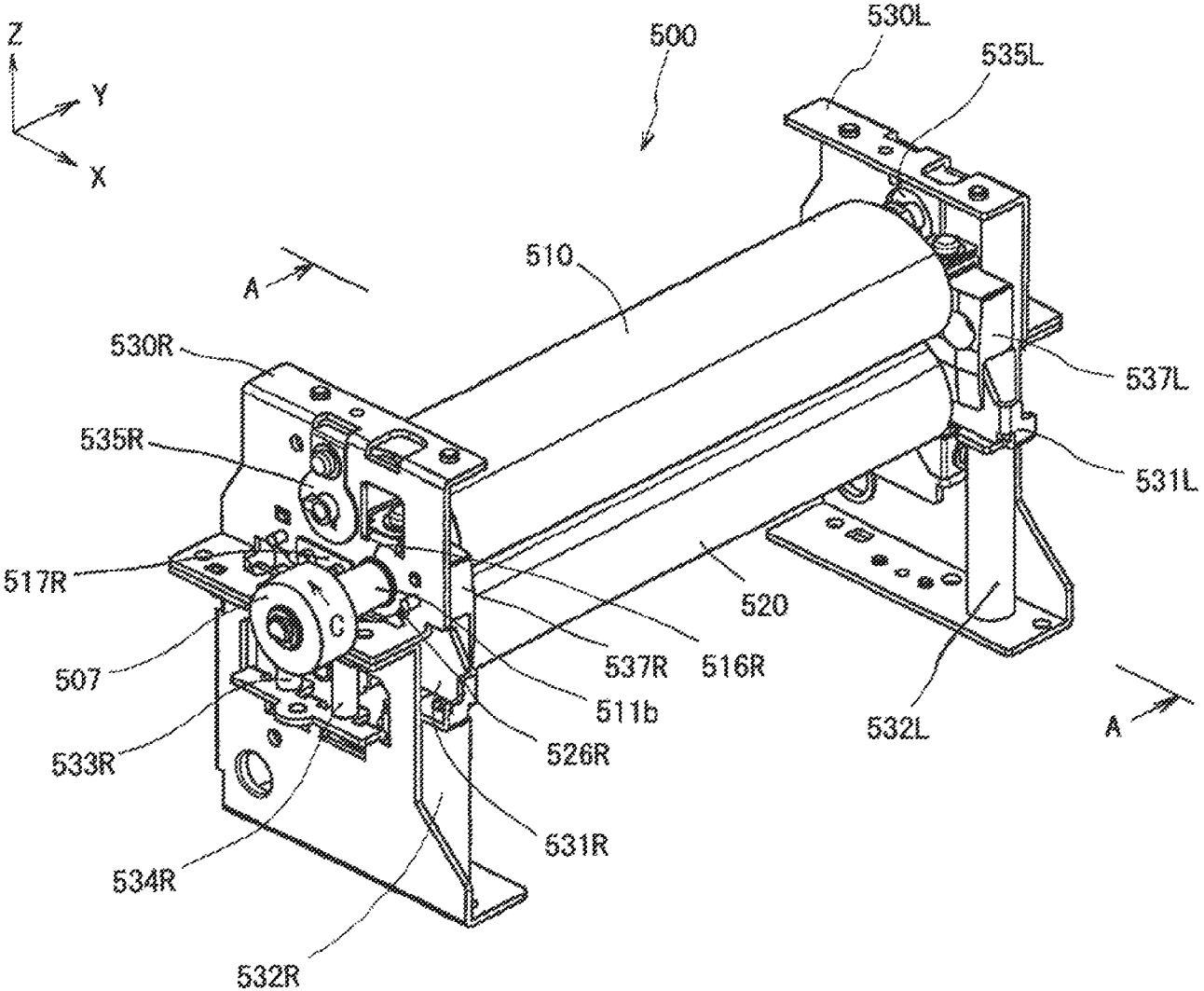
FIG. 2 is an appearance perspective view of a fuser unit in the first embodiment.
Figure 5:
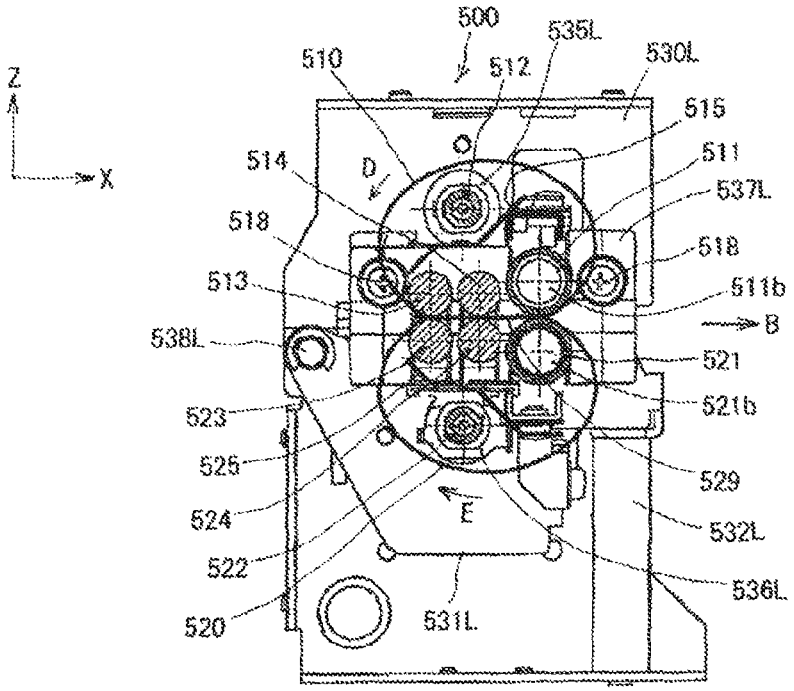
FIG. 5 is an inside configuration view of the fuser unit, illustrating the cross section A-A illustrated in FIG. 2 viewed from the y-axis minus side.
Figure 16:
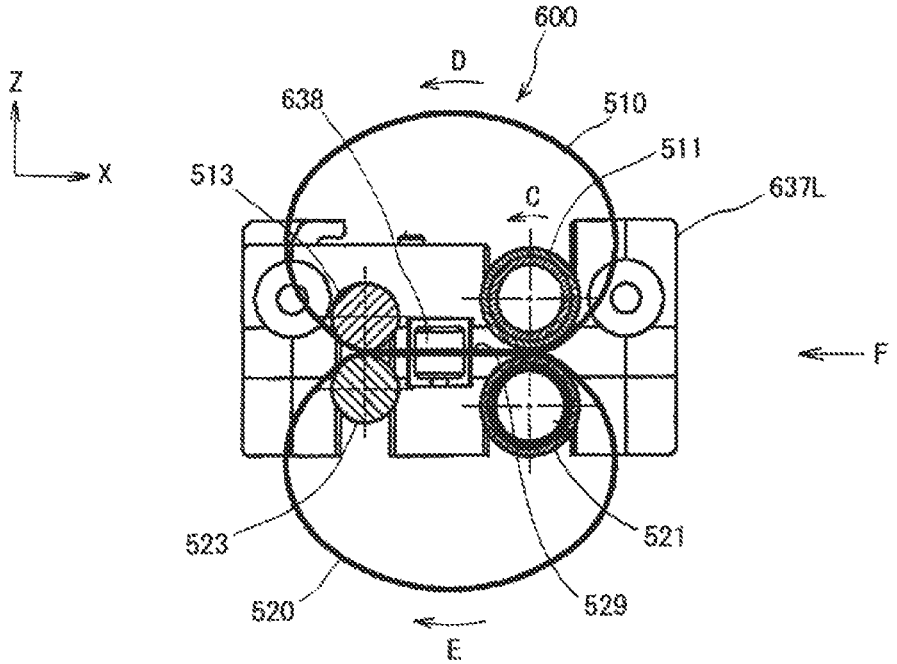

FIG. 16 is an inside configuration view of a fuser unit in the second embodiment viewed from the direction corresponding to the cross section A-A illustrated in FIG. 2 as being similar to FIG. 5.

Figure 17:
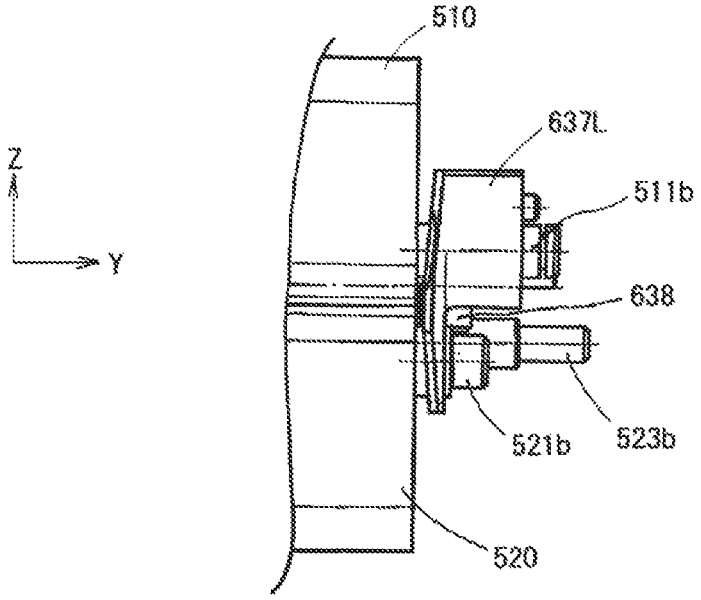

FIG. 17 is a side view of the fuser unit in FIG. 16 viewed from the direction of the arrow F.

Figure 18C:
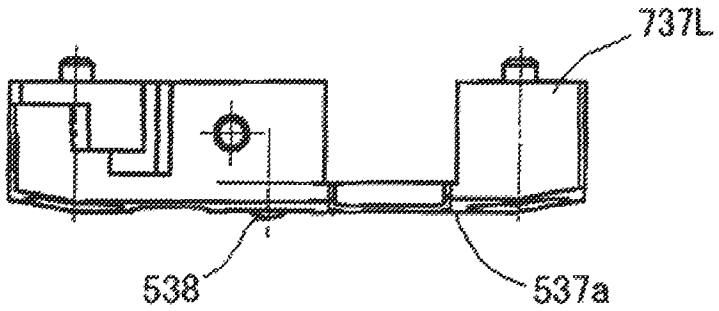
Figure 18B:
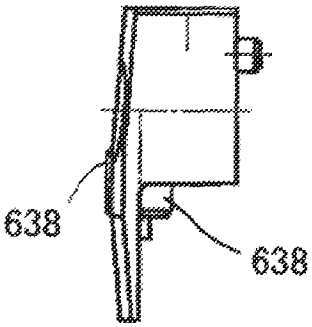
Figure 18A:
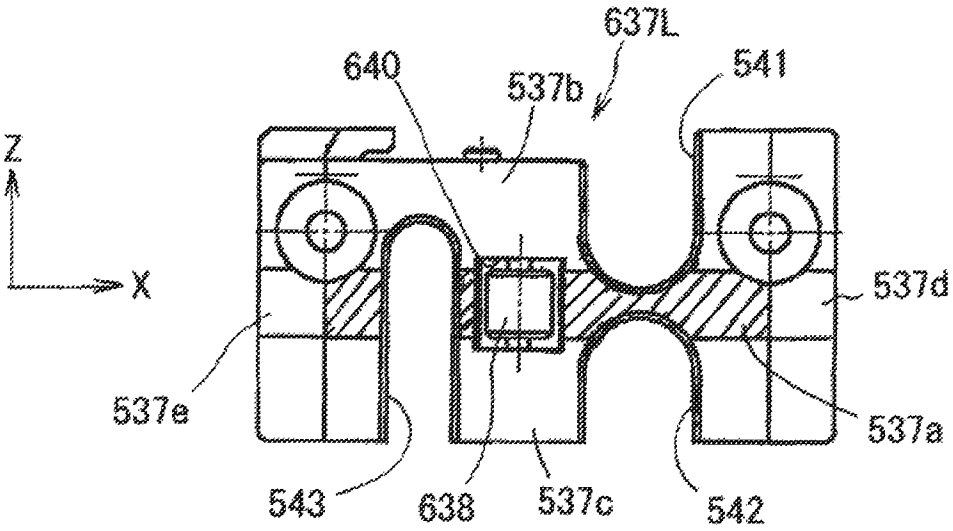

FIGS. 18A, 18B, and 18C are configuration views illustrating the form of a belt guide illustrated in FIG. 16. FIG. 18A is a front view thereof, FIG. 18B is a right side view thereof, and FIG. 18C is a top view thereof.

Figure 19:
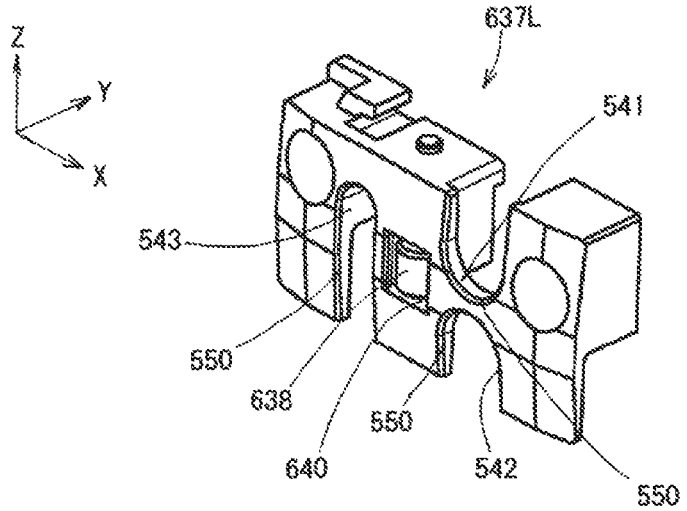

FIG. 19 is an appearance perspective view of the belt guide illustrated in FIG. 16.

Figure 20:
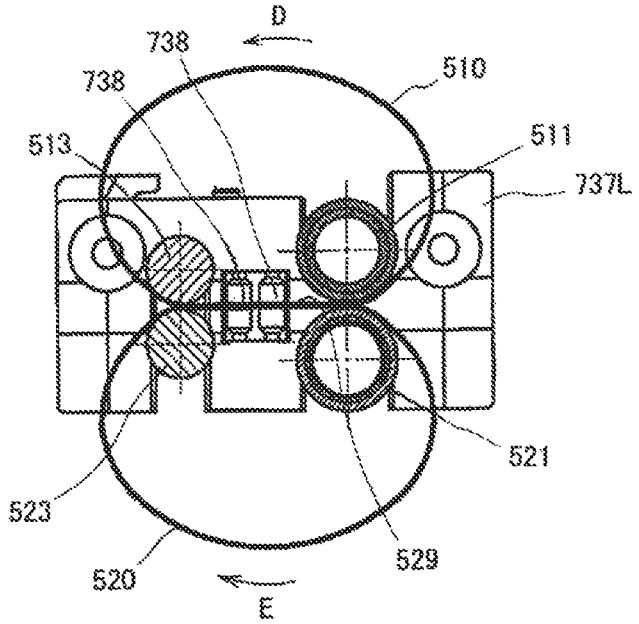

FIG. 20 is an inside configuration view illustrating an example of another configuration of the belt guide in the second embodiment.

Figure 21:
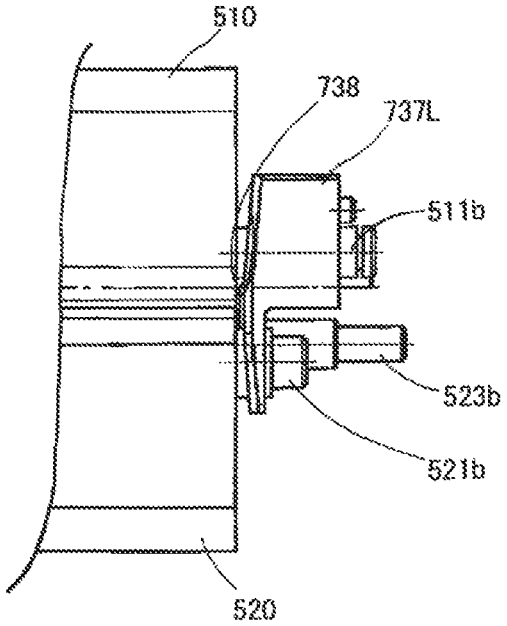

FIG. 21 is a side view of the fuser unit illustrated in FIG. 20.

Figure 22C:
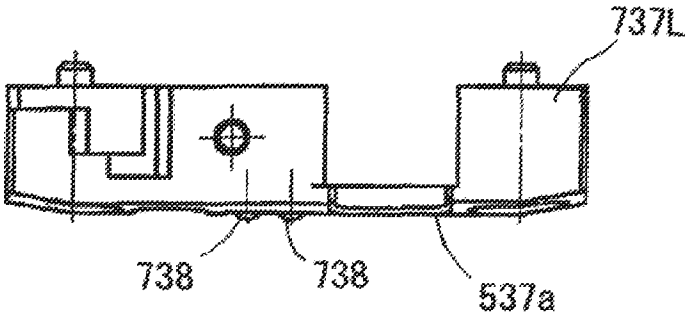
Figure 22B:
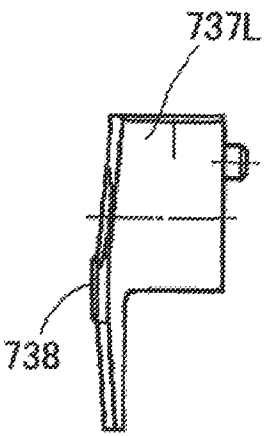
Figure 22A:
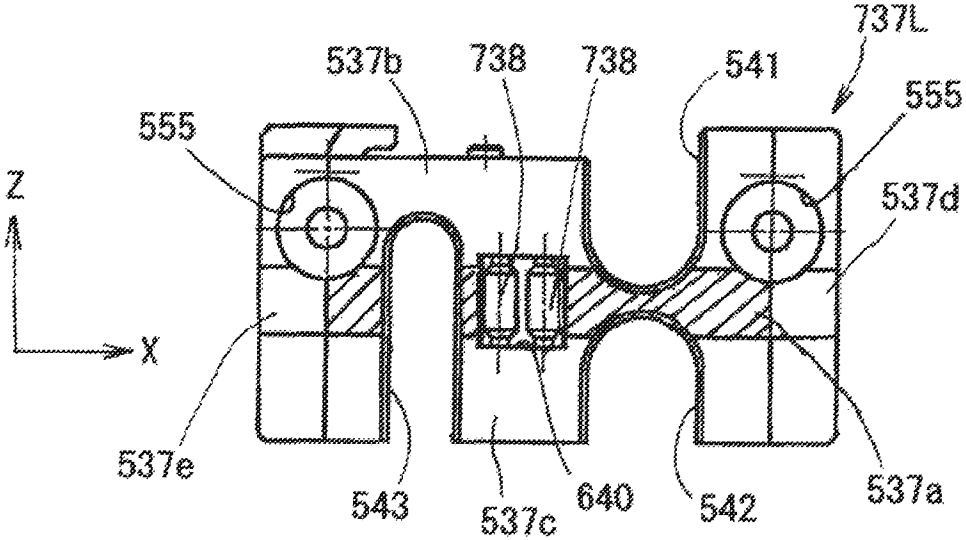

FIGS. 22A, 22B, and 22C are configuration views illustrating the form of the belt guide in FIG. 20. FIG. 22A is a front view thereof, FIG. 22B is a right side view thereof, and FIG. 22C is a top view thereof.

Figure 23:
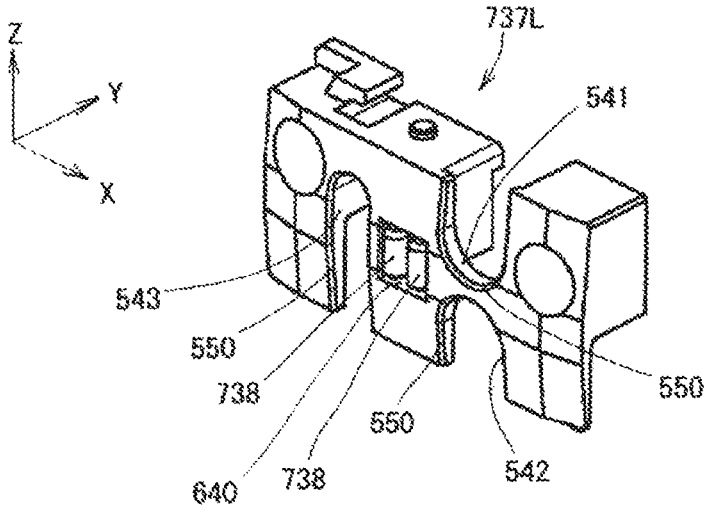

FIG. 23 is an appearance perspective view of the belt guide illustrated in FIG. 20.

Figure 24:
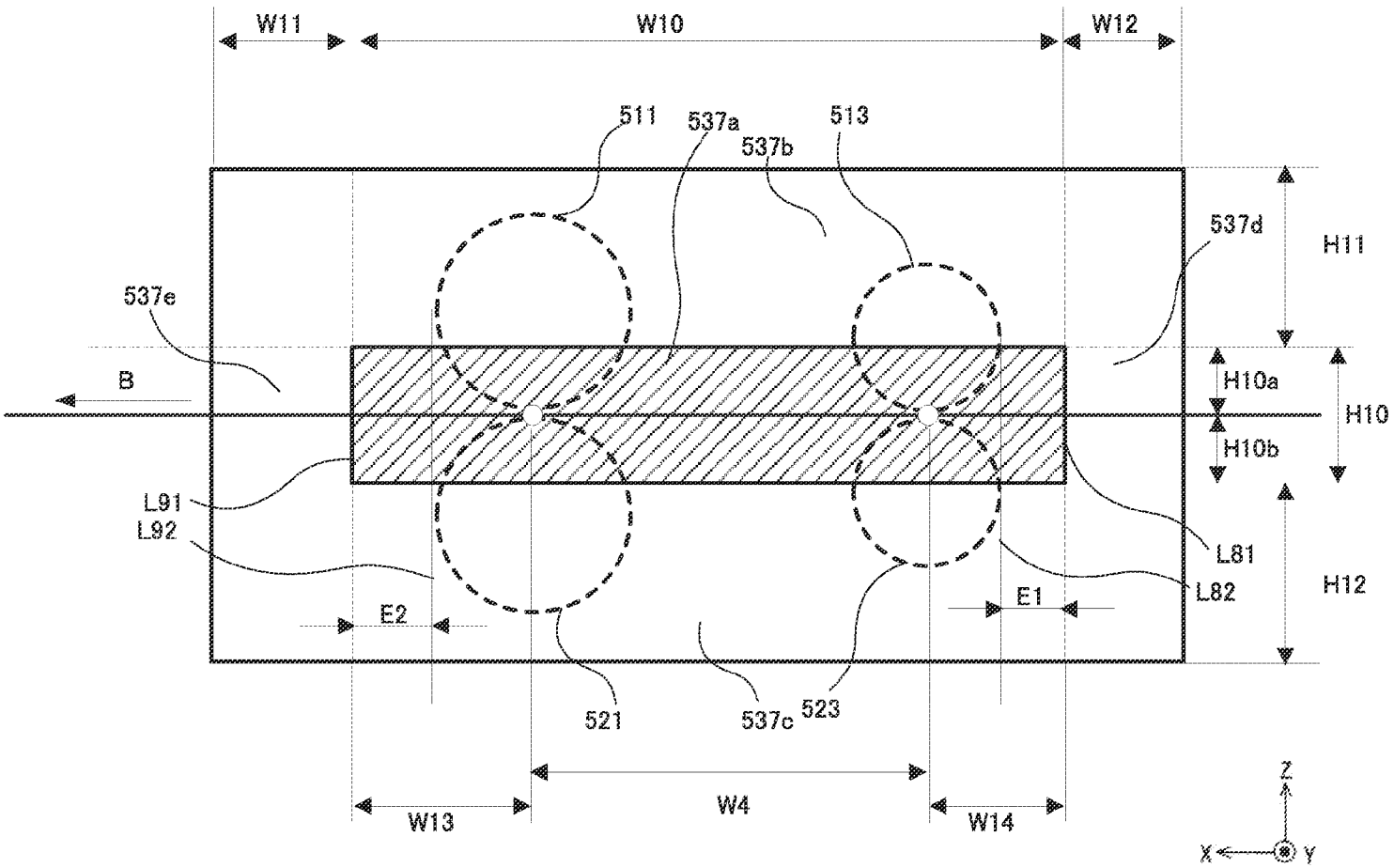

FIG. 24 is an explanatory view to explain the scales of the nip area and the peripheries.

DETAILED DESCRIPTIONS OF PREFERRED EMBODIMENTS

First Embodiment

Figure 1:
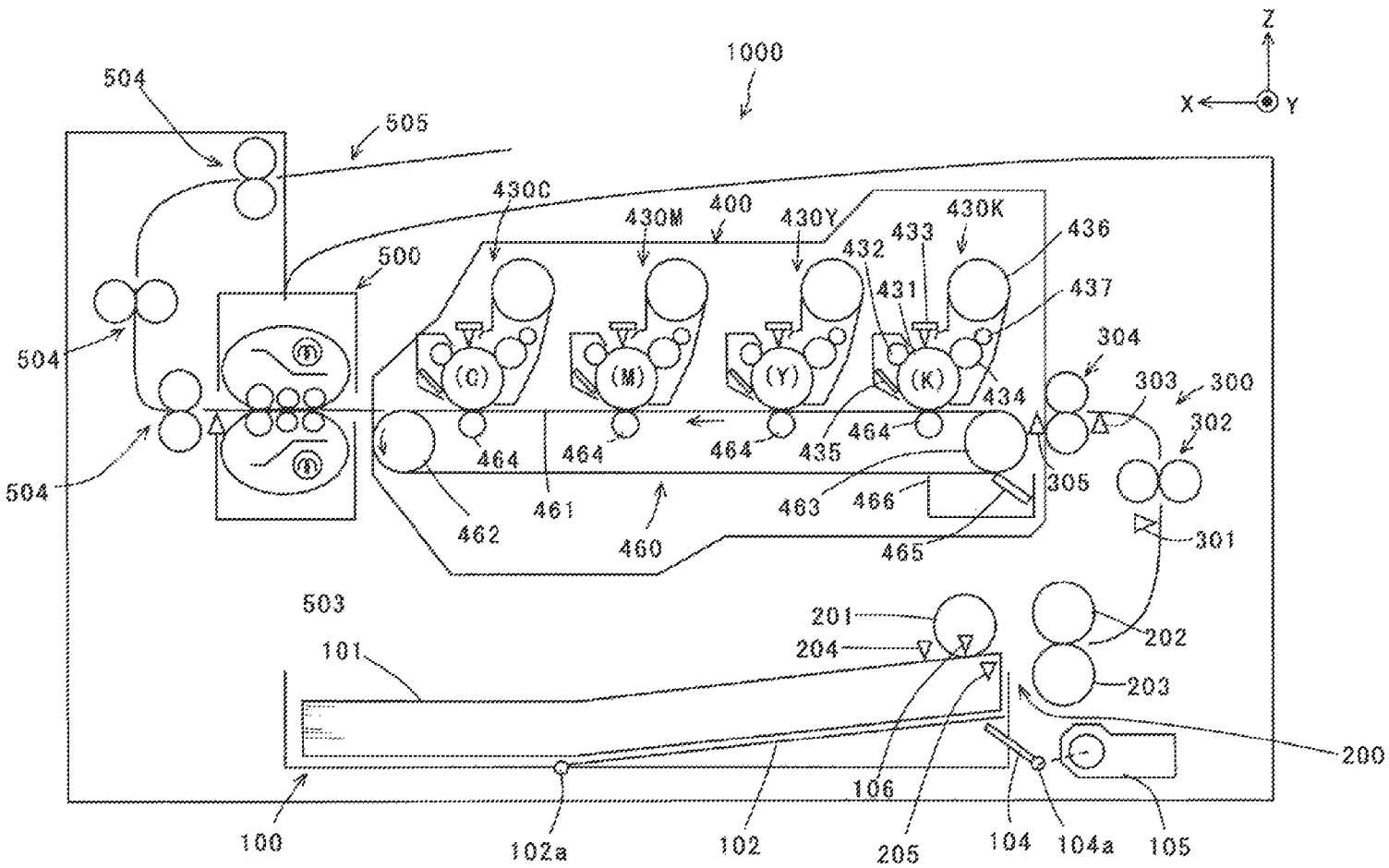
FIG. 1 is a main part configuration view schematically illustrating a main part configuration in the first embodiment of an image forming apparatus according to the present invention.

FIG. 1 is a main part configuration view schematically illustrating a main part configuration in the first embodiment of an image forming apparatus according to the present invention.

An image forming apparatus 1000 illustrated in FIG. 1 is provided with a configuration as, for example, a color electrographic printer. In FIG. 1, a sheet feeding tray 100 is detachably installed in the image forming apparatus 1000 main body and accommodates a record sheet 101 as a medium that is stacked inside. Inside the sheet feeding tray 100, a sheet place pallet 102 is rotatably disposed at a support shaft 102*a*, and the record sheet 101 is placed on the sheet place pallet 102. Also, in the sheet feeding tray 100, a guide member (not illustrated) to regulate the stack position of the record sheet 101 is disposed, and it guides the feeding direction of the record sheet 101 and the direction that is perpendicular with respect to the feeding direction and maintains the stack position of the record sheet 101 that is held inside in a certain position.

At the side of the record sheet feeding direction of the sheet feeding tray 100, a lift up lever 104 is rotatably disposed at a support shaft 104*a*, and the support shaft 104*a* is detachably engaged with a motor 105. When the sheet feeding tray 100 is installed in the image forming apparatus 1000 main body, the lift up lever 104 and the motor 105 are engaged, and a control part (not illustrated) drives the motor 105. Thereby, the lift up lever 104 rotates so that the tip part of the lift up lever 104 lifts up the bottom part of the sheet place pallet 102 as the support shaft 102*a* is the center of the rotation and elevates the record sheet 101 that is stacked on the sheet place pallet 102. When the record sheet 101 is elevated to the certain height, the elevation detection part 106 detects it, and the control part (not illustrated) stops the motor 105 based on the information detected by the elevation detection part 106.

At the side of the feeding direction of the sheet feeding tray 100, a sheet feeding part 200 (or medium feeding part) to feed the record sheet 101 one by one is disposed. At the sheet feeding part 200, a pick-up roller 201 to contact and press the record sheet 101 that is elevated to the certain height and a roller pair of a feed roller 202 and a retard roller 203 to separate the record sheet 101 one by one that is fed by the pick-up roller 201 are disposed. Also, at the sheet feeding part 200, a sheet existence detection part 204 to detect whether the record sheet 101 exists or not and a sheet residual quantity detection part 205 to detect the sheet residual quantity are disposed.

The record sheet 101 separated one by one and fed by the sheet feeding part 200 is sent to a sheet carrying part 300. The record sheet 101 fed by the sheet feeding part 200 passes through a sheet sensor 301, and is sent to a carrying roller pair 302. By a drive part (not illustrated), the carrying roller pair 302 is started to rotate at a timing that is delayed for the predetermined time from the time when the record sheet 101 passes through the sheet sensor 301. Thereby, the record sheet 101 is stuffed into a pressing part of the carrying roller pair 302 in a state where the sheet slightly tiles, pressing part and the skew is corrected. The record sheet 101 that is sent by the carrying roller pair 302 passes through a sheet sensor 303 and, it is sent to a carrying roller pair 304. The carrying roller pair 304 is rotated by the drive part (not illustrated) from the time when the record sheet 101 passes through the sheet sensor 303, and it sends the record sheet 101 without stopping. The record sheet 101 that is sent by the carrying roller pair 304 passes through a writing sensor 305, and it is sent to an image forming part 400.

The image forming part 400 consists of a toner image forming part 430K that contains black toner (K), a toner image forming part 430Y that contains yellow toner (Y), a toner image forming part 430M that contains magenta toner (M), and a toner image forming part 430C that contains cyan toner (C), which are lined up from the upstream side in the feeding direction of the record sheet 101 in series, (hereinafter those are referred to as the toner image forming part 430 when they are not needed to be distinguished) and a transfer part 460 to transfer a toner image formed by the toner image forming part 430 to the top surface of the record sheet 101 by the Coulomb force.

The four toner image forming parts 430 lined up in series all have the same configuration. Only the toner colors that are used, that is, black (K), yellow (Y), magenta (M), and cyan (C), are different. Therefore, here, the inside configuration of the black toner image forming part 430K that is arranged at the most upstream side in the sheet carrying direction of the record sheet is explained as an example.

The toner image forming part 430 is provided with a photosensitive drum 431 to hold the toner image, a charge roller 432 to charge the surface of the photosensitive drum 431, a LED head 433 that consists of LED array to form an electrostatic latent image on the surface of the charged photosensitive drum 430, a development roller 434 to form a toner image on the electrostatic latent image by the frictional charge, a toner contain part 436 to supply toner, a supply roller 437 to supply toner from the toner contain part 436 to the development roller 434, a cleaning blade 435 to scrape the remaining toner on the surface of the photosensitive drum 431 after the transfer, and the like.

The transfer part 460 consists of an endless transfer belt 461 that electrostatically sticks and carries the record sheet 101, a drive roller 462 that is rotated in the arrow direction by the driven part (not illustrated) and moves and drives the transfer belt 461, a tension roller 463 that makes a pair with the drive roller 462 and stretches the transfer belt 461, four transfer rollers 464 that are arranged so as to respectively face, contact and press the photosensitive drums 431 of the toner image forming parts 430 and apply the voltage so as to transfer the toner images to the record sheet 101, a cleaning blade 465 that scrapes and cleans the toner attached on the transfer belt 461, and a toner box 466 that piles up the toner scraped off by the cleaning blade 465.

The toner image forming part 430 and the transfer belt 461 are driven at the same time, and sequentially pile and transfer each color of the toner images to the record sheet 101 that is electrostatically stuck and carried by the transfer belt 461. In this way, the record sheet 101 on which the toner image is transferred at the image forming part 400 is sent to a fuser unit 500 as a fuser device where the toner image is fused and stuck to the record sheet 101 by heat and pressure.

The fuser unit 500 applies heat and pressure to the toner image on the record sheet 101 that is sent in the carrying direction of the record sheet by the image forming part 400 and melts the toner image to fuse it on the record sheet 101. After that, the record sheet 101 where the fusion is conducted is ejected to a stacker part 505 by an ejection roller pair 504.

Regarding the axes X, Y, and Z in FIG. 1, when the record sheet 101 passes through the image forming part 400, the carrying direction of the record sheet 101 is the x-axis, the rotation shaft direction of the photosensitive drum 431 is the y-axis, and the direction perpendicular to these X and Y axes is the z-axis.

Also, in other figures described later, when X, Y, and Z axes are illustrated, these axes directions show the same directions. That is, X, Y, and Z axes in each figure show the arrangement direction when the part illustrated in each figure configures the image forming apparatus 1000 in FIG. 1. Also, here, the z-axis is arranged to be the almost vertical direction.

Figure 4:
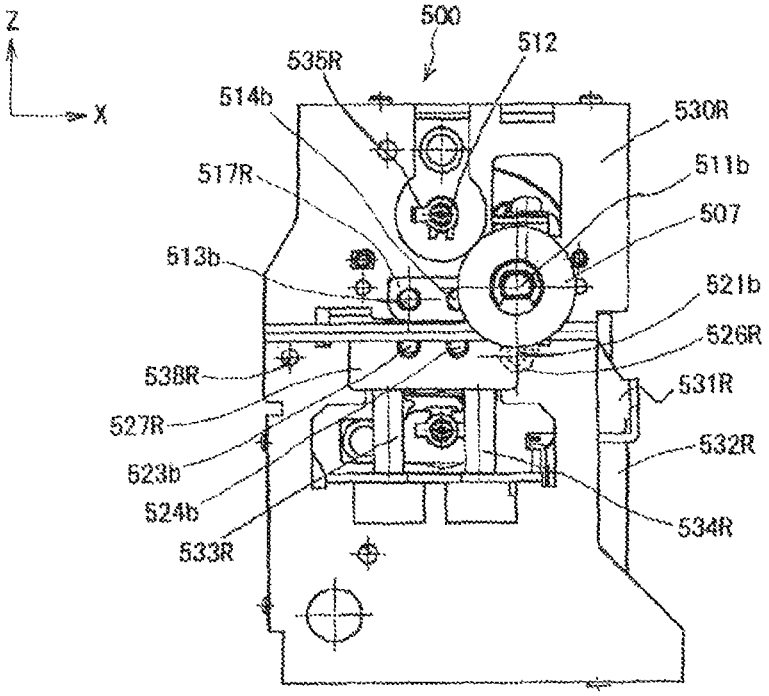
FIG. 4 is a side view of the fuser unit viewed from the y-axis minus side in FIG. 2.
Figure 6:
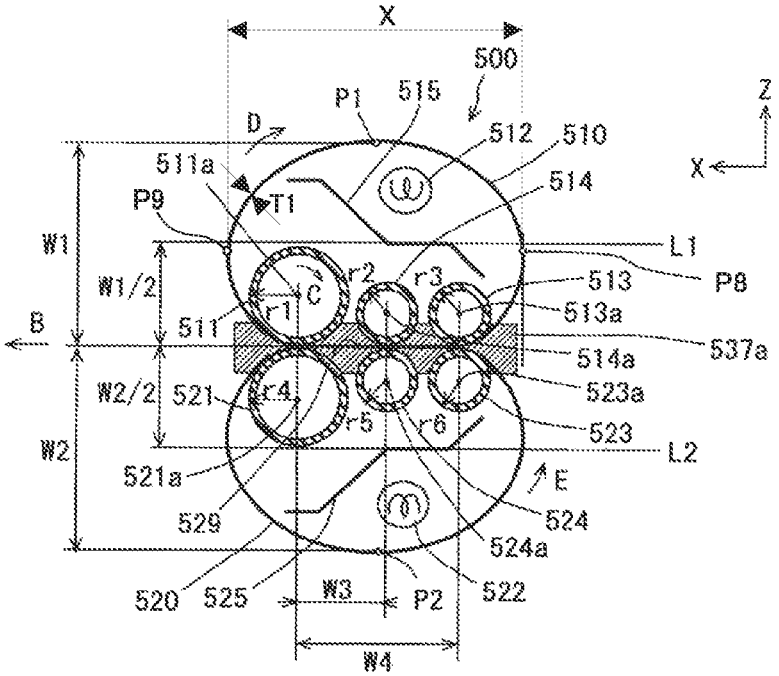
FIG. 6 is an explanatory view to explain the basic configuration of the fuser unit in the first embodiment.

FIG. 2 is an appearance perspective view of the fuser unit 500 in the present embodiment, FIG. 3 is the front view viewed from the x-axis plus side, FIG. 4 is the side view viewed from the y-axis minus side, FIG. 5 is the inside configuration view viewed from the cross section A-A illustrated in FIG. 2, and FIG. 6 is the explanatory view to explain the basic configuration of the fuser unit 500. Referring to these figures, the configuration of the fuser unit 500 is explained. FIG. 6 shows the configuration viewed from the opposite side with respect to FIG. 5.

As illustrated in FIG. 6, the fuser unit 500 is provided with a fuser belt 510 as an endless belt part (or first belt part) and a pressure application belt 520 as a second belt part. Inside the fuser belt 510, a drive roller 511 as a first roller (or first nip forming part) to support a straight line movement path of the fuser belt 510 as contacting the inside surface of the fuser belt 510, a driven roller 513 as a third roller (or third nip forming part), and an auxiliary roller 514 as a fifth roller (or fifth nip forming part) are arranged. Inside the pressure application belt 520, a pressure application roller 521 as a second nip forming part to support a straight line movement of the pressure application belt 520 as contacting the inside surface of the pressure application belt 520, a driven pressure application roller 523 as a fourth roller (or fourth nip forming part), an auxiliary pressure application roller 524 as a sixth roller (or fourth nip forming part) are arranged. The above first to sixth nip forming parts are configured with rollers. As long as these nip forming parts can create the nip area therebetween by pinching the fuser belt 510, it is not necessary to use rollers. Pads instead of rollers are applicable. Also, a combination of pads and rollers may be applicable in an engineering view.

The drive roller 511 and the pressure application roller 521 that are pressed each other via the fuser belt 510 and the pressure application belt 520 are arranged at the downstream side in the carrying direction (the arrow B direction) of the record sheet. Likewise, the driven roller 513 and the driven pressure application roller 523 that are pressed each other via the fuser belt 510 and the pressure application belt 520 are arranged at the upstream side in the carrying direction of the record sheet.

Likewise, the auxiliary roller 514 and the auxiliary pressure application roller 524 that are pressed each other via the fuser belt 510 and the pressure application belt 520 are arranged in the middle of these rollers. The pressing part of each roller pair is arranged on the straight line along the carrying path of the record sheet so that the nip area is formed. The nip area is defined from the pressing part of the driven roller 513 and the driven pressure application roller 523 to the pressing part of the drive roller 511 and the pressure application roller 521. The width of this nip area is referred to as a total nipping width W4.

Figure 8:
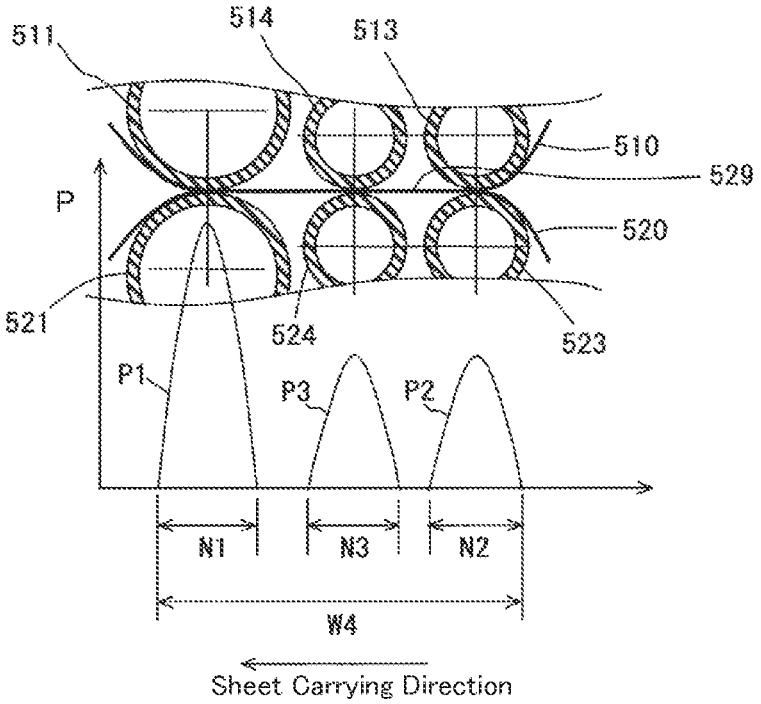
FIG. 8 is an explanatory view to explain the pressure distribution of the nip area in the first embodiment.

FIG. 8 is an explanatory view to explain the pressure distribution of the nip area. As illustrated in FIG. 8, at a nip area 529 with the total nipping width W4, a nipping pressure P1 of the nipping N1 formed by the pressure application roller 521 and the drive roller 511, a nipping pressure P2 of the nipping N2 formed by the driven pressure application roller 523 and the driven roller 513, a nipping pressure P3 of the nipping N3 formed by the auxiliary pressure application roller 524 and the auxiliary roller 514 are generated. Here, the nipping pressures are set to be $$P1>P3=P2$$

(however, those are compared with the maximum value of each nipping pressure).

Here, the fuser belt 510 is not stretched between the drive roller 511 and the driven roller 513, and the pressure application belt 520 is also not stretched between the pressure application roller 521 and the driven pressure application roller 523, either. These belts are arranged to travel/rotate in a tension free state. That is, "tension free or tension free state", here, means that the fuser belt 510 and the pressure application belt 520 that form the nip area 529 are able to travel/rotate without any supporting parts for traveling. Namely, a pressure or stress is applied to only at the nip area 529. To realize the tension free state, it is required to use a belt with a predetermined firmness. More specifically described, the tension free state may be defined as a state where, for the fuser belt 510, there is no tension/stress applied to the belt 510 in the sheet carrying direction. With respect to the tension fee state and the belt that is able to travel in the tension free state, the present application is incorporated by reference with U.S. patent application, Ser. No. 14/018,920 filed on Sep. 5, 2013.

Therefore, the nip area 529 here is formed only by the first pair of rollers configured by the drive roller 511 and the pressure application roller 521, the second pair of rollers configured by the auxiliary roller 514 and the auxiliary pressure application roller 524, the third pair of rollers configured by the driven roller 513 and the driven pressure application roller 523, and the fuser belt 510 and the pressure application belt 520 that are nipped by each roller pair.

Figure 9:
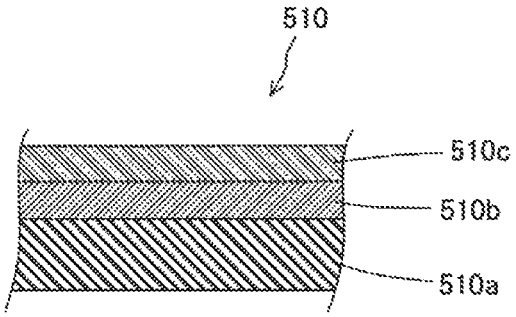
FIG. 9 is a partial cross sectional view to explain a laminate structure of the fuser belt.

Thereby, as illustrated in FIG. 9 that is the partial cross sectional view, the fuser belt 510 (here, the pressure application belt 520 has the same configuration) has a base material 510*a* at the internal circumference surface, an elastic layer 510*b* at the external circumference of the base material 510*a*, and a release layer 510*c* at the external circumference of the elastic layer 510*b*, and the base material 510*a* is an endless belt consists of a metal with elasticity such as SUS and the like. The thickness of the base material 510*a* is approximately 40 μm to 70 μm, and it is preferable that the belt itself has moderate rigidity and flexibility. The elastic layer 510*b* is a silicone rubber layer formed on the base material 510*a*. Also, the release layer is a fluorine-based resin layer such as PFA, PTFE, and the like formed on the elastic layer, and it is formed on the elastic layer by covering of the tube, coating, or the like. It is possible to form a direct release layer on the base material without forming an elastic layer and use it. Also, the base material 510*a* may be an endless belt consists of a resin such as PI and the like.

As illustrated in FIG. 6, here, the rotation center 511*a* of the drive roller 511, the rotation center 513*a* of the driven roller 513, and the rotation center 514*a* of the auxiliary roller 514 are configured to be positioned closer to the nip area 529 than to the belt center L1 of the fuser belt 510 in the tension free state. The belt center L1 is determined to be a half of a distance W1 (W1/2). Wherein the distance W1 is determined as a distance from an internal circumference end part P1 of the fuser belt 510 to the nip area 529 in the z-axis direction. In the embodiment, the end part P1 is determined when the fusion belt 510 does not travel. Putting it another way, radiuses r1, r2, r3 of the rollers 511, 513, 514 are smaller than a quarter of the distance W1.

Similarly, the rotation center 521*a* of the pressure application roller 521, the rotation center 523*a* of the driven pressure application roller 523, and the rotation center 524*a* of the auxiliary pressure application roller 524 are configured to be positioned closer the nip area 529 than to the belt center L2 of the pressure application 520 in the tension free state. The belt center L2 is determined to be a half of a distance W2 (W2/2). Wherein the distance W2 is determined as a distance from an internal circumference end part P2 of the pressure application belt 520 to the nip area 529 in the negative z-axis direction. In the embodiment, the end part P2 is determined when the pressure application belt 520 does not travel. Putting it another way, radiuses r4, r5, r6 of the rollers 521, 523, 524 are smaller than a quarter of the distance W2.

At the internal circumference of the fuser belt 510, a heater 512 as a heat application source is arranged. Here, a halogen heater is used as the heater 512. However, instead of this halogen heater, an induction heating body and the like may be used. Also, a reflection plate 515 is arranged so that the heat from the heater 512 does not directly heat the drive roller 511, the driven roller 513, or the auxiliary roller 514. Here, the reflection plate 515 is used. However, instead of this reflection plate 515, a halogen heater with a reflection film, which is a halogen heater that has a reflection film, may be used.

Similarly, at the internal circumference of the pressure application belt 520, a heater 522 as a heat application source is arranged. Here, a halogen heater is used as the heater 522. However, instead of this halogen heater, an induction heating body and the like can be used. Also, a reflection plate 525 is arranged so that the heat from the heater 522 does not directly heat the pressure application roller 521, the driven pressure application roller 523, or the auxiliary pressure application roller 524. Here, the reflection plate 525 is used. However, instead of this reflection plate 525, a halogen heater with a reflection film, which is a halogen heater that has a reflection film, may be used.

As illustrated in FIG. 5, in the present embodiment, when the heater 512 as the heat application source is viewed from the rotation shaft direction of the drive roller 511, it is arranged at the upstream side of the drive roller 511 in the carrying direction of the record sheet (the direction of the arrow B) and at the area between the auxiliary roller 514 and/or the driven roller 513 and the internal circumference surface of the fuser belt 510. Similarly, the heater 522 is also arranged at the upstream side of the pressure application roller 521 in the carrying direction of the record sheet, and at the area between the auxiliary pressure application roller 524 or/and the driven pressure application roller 523 and the internal circumference surface of the pressure application belt 520.

As being more specifically explained, the heater 512 is arranged at the upstream side of the drive roller 511 in the carrying direction of the record sheet, and at the area between the outer tangent line that is opposite to the nip area 529 of the auxiliary roller 514 and the driven roller 513 and the internal circumference surface of the fuser belt 510. Similarly, the heater 522 is arranged at the upstream side of the pressure application roller 521 in the carrying direction of the record sheet, and at the area between the outer tangent line that is opposite to the nip area 529 of the auxiliary pressure application roller 524 and the driven pressure application roller 523 and the internal circumference surface of the pressure application belt 520.

As described later, the drive roller 511 rotates in the direction of the arrow C (FIG. 6) accepting a driving force from outside and drives the moving member such as other rollers and belts and the like. Thereby, the fuser unit 500 carries the record sheet 101 on which the toner image is transferred but not fused yet to the arrow B direction while nipping at the nip area 529, and melts the toner to fuse the toner image at the same time.

The fuser unit 500 is further provided with following basic characteristics. Respective rotation centers 521*a* and 511*a* of the pressure application roller 521 and the drive roller 511 are arranged on the same surface that is almost perpendicular with respect to the carrying direction of the record sheet. Here, the almost perpendicular means that the surface is at an angle in the range of 85 degrees to 95 degrees with respect to the carrying direction of the record sheet. The driven pressure application roller 523 is arranged to face the driven roller 513, and it is pressurized via the fuser belt 510 and the pressure application belt 520 to the driven roller 513. Respective rotation centers 523*a* and 513*a* of the driven pressure application roller 523 and the drive roller 513 are arranged on the same surface that is almost perpendicular with respect to the carrying direction of the record sheet. Here, the almost perpendicular means that the surface is at an angle in the range of 85 degrees to 95 degrees with respect to the medium carrying direction. The auxiliary pressure application roller 524 is arranged to face the auxiliary roller 514, and it is pressurized via the fuser belt 510 and the pressure application belt 520 to the auxiliary roller 514. Respective rotation centers 524*a* and 514*a* of the auxiliary pressure application roller 524 and the auxiliary roller 514 are arranged on the same surface that is almost perpendicular with respect to the carrying direction of the record sheet. Here, the almost perpendicular means that the surface is at an angle in the range of 85 degrees to 95 degrees with respect to the medium carrying direction. The pressure application roller 521, the fuser belt 510, and the pressure application belt 520 are driven and rotated accompanied by the rotation in the arrow C direction of the drive roller 511, and the driven pressure application roller 523, the driven roller 513, the auxiliary pressure application roller 524, and the auxiliary roller 514 are driven and rotated accompanied by the rotation in the arrow D direction of the fuser belt 510 and the rotation in the arrow E direction of the pressure application belt 520.

Considering the point above, the configuration of the fuser unit 500 of the embodiment is further explained.

As illustrated in FIG. 2-FIG. 5, the rotation shaft 511*b* of the drive roller 511 that is arranged inside the fuser belt 510 is rotatably maintained in brackets 530R and 530L that are arranged to face each other at the right and left sides of the device (refer to FIG. 2) via bearings 516R and 516L (516L is not illustrated) that are fixed on the each bracket. One end side of the rotation shaft 511*b* penetrates the bracket 530R and extends and exists outside the bracket 530R in the shaft direction of the rotation shaft 511*b*, and a driving gear 507 is fixed at the end part.

As described later, in order to support the drive roller 511, the driven roller 513, the auxiliary roller 514, the pressure application roller 521, the driven pressure application roller 523, and the auxiliary pressure application roller 524 at the both sides of each of the rollers, the brackets 530R, 530L and the like are arranged in a plane symmetry configuration to face each other at the right and left sides with respect to a virtual plane 501 (FIG. 3) that perpendicularly crosses in the middle sections of the drive roller 511 and the fuser unit 500. Therefore, when viewed from the negative side of the x-axis (back side of the sheet surface of FIG. 3), the symmetry members are distinguished by adding the letter R (for the member of the right side) or L (for the member of the left side) at the end. When it is not necessary to distinguish L or R, these letters at the end sometimes are omitted.

As being similar to the drive roller 511, a rotation shaft 513*b* and a rotation shaft 514*b* of the driven roller 513 and the auxiliary roller 514 that are arranged inside the fuser belt 510 (FIG. 5) are also rotatably maintained by bearings 517R and 517L (517L is not illustrated) fixed on the brackets 530R and 530L. In the embodiment, as the bearing for the driven roller 513 and the auxiliary roller 514, a bearing that is integrally formed is used. However, instead of this bearing, a bearing that individually maintains each roller may be used.

In contrast, a rotation shaft 521*b* of the pressure application roller 521 that is arranged inside the pressure application belt 520 is rotatably supported by pressure application roller levers 531R and 531L (FIG. 2) via bearings 526R and 526L (526L is not illustrated) respectively fixed on the pressure application roller levers.

Figure 7:
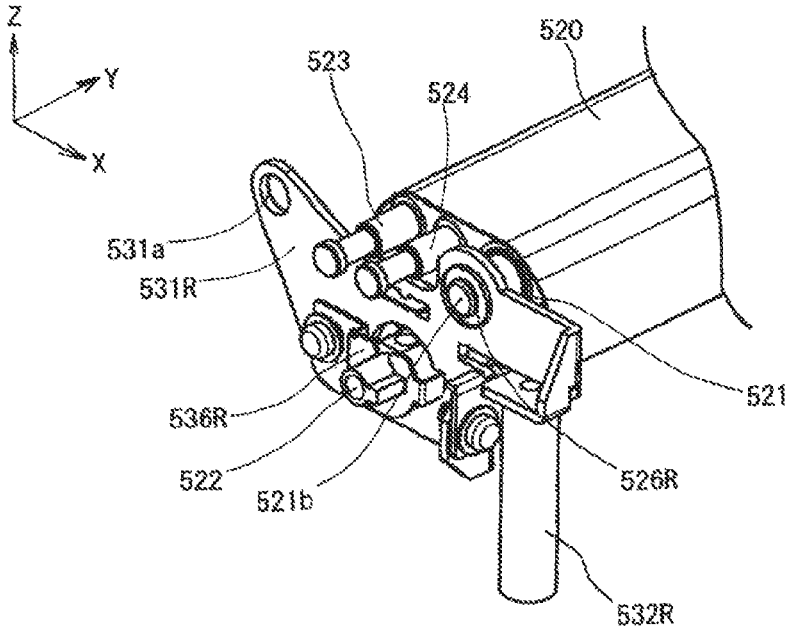
FIG. 7 is a partial perspective view partially illustrating a pressure application roller lever of the right side and members related to this.

FIG. 7 is a partial perspective view partially illustrating the pressure application roller lever 531R and the member related to this. This pressure application roller lever 531R is arranged inside the bracket 530R in FIG. 2.

As illustrated in FIG. 7, the pressure application roller lever 531R that rotatably holds the pressure application roller 521 is provided with a fulcrum 531*a* at one end side. By using the fulcrum 531*a* as a pivot, the pressure application roller lever 531R is rotatably supported with a rotation shaft 538R (FIG. 4) that is arranged on the bracket 530R. At the other end, the pressure application roller lever 531R is provided with a spring 532R that is arranged in a state where it is compressed between the pressure application roller lever 531R and the bracket 530R. The pressure application roller lever 531R is biased by this spring 532R, and the pressure application roller 521 is pressed against the drive roller 511 with the predetermined pressure in a manner of nipping the fuser belt 510 and the pressure application belt 520.

At this time, as described above, the respective rotation centers 521*a* and 511*a* of the pressure application roller 521 and the drive roller 511 (FIG. 6) are arranged so as to be on the same surface that is almost perpendicular with respect to the carrying direction of the record sheet. Here, the configuration at the bracket 530R side is explained. However, as described above, the configuration at the bracket 530L side that is configured to be the plane symmetry also has a similar configuration. In a practical view, it is not necessary for the left and right brackets to be identical. Considering its required function, the brackets may be customized in a different way.

Being similar to the pressure application roller 521, the rotation shaft 523*b* and the rotation shaft 524*b* of the driven pressure application roller 523 and the auxiliary pressure application roller 524 that are arranged inside the pressure application belt 520 are rotatably maintained at the one end side (R side) by the bearing 527R (FIG. 4) that is slidably maintained on the bracket 530R. The bearing part 527R is slidably arranged in the direction of the driven roller 513 and the auxiliary roller 514 with respect to the bracket 530R, and the spring 533R and 534R as the bias member to bias the bearing 527R are arranged.

The driven pressure application roller 523 is biased toward the driven roller 513 by the spring 533R, and similarly, the auxiliary pressure application roller 524 is biased toward the auxiliary roller 514 by the spring 534R. That is, each roller is independently biased by a spring and respectively pressurized by a facing roller. In the embodiment, as a bearing of the driven roller 523 and the auxiliary roller 524, a bearing that is integrally formed is used. However, instead of this bearing, a bearing that individually maintains each roller may be used. Also, here, the configurations of the bracket 530R and the pressure roller lever 531R at R side are explained. However, the configurations of the bracket 530L and the pressure application roller lever 531L at L side that are configured to be the plane symmetry have a similar configuration.

Also, the pressing part of each roller pair is arranged on almost the same plane at the nip area 529 (FIG. 6) so as not to give stress to the fuser belt 510 and the pressure application belt 520, and the nip area 529 at the total nipping width W4 forms the straight record sheet carrying part that is almost parallel with respect to the carrying direction of the record sheet.

Here, "almost parallel" ranges within ±5 degrees of the carrying direction of the record sheet. Also, here, "arranged on almost the same plane" means that each roller pair is arranged so that the distance from the line connects the upstream side end part of the pressing part of the drive roller 511 and the pressure application roller 521 in the sheet carrying direction and the downstream side end part of the pressing part of the drive roller 513 and the driven pressure application roller 523 in the sheet carrying direction to the pressing part of the auxiliary roller 514 and the auxiliary pressure application roller 524 becomes 20% or less of the roller radius r2 of the auxiliary roller 514.

In FIG. 6, the total nipping width W4, which is from the pressing part of the driven roller 513 and the driven pressure application roller 523 to the pressing part of the drive roller 511 and the pressure application roller 521, can be changed by moving the position of the driven roller 513 and the driven pressure application roller 523, which make a pair, in the record sheet carrying direction.

Also, by changing the arrangement number of the auxiliary roller 514 and the auxiliary pressure application roller 524 that make a pair and are arranged between the drive roller 511 and the pressure application roller 521 that make a pair and the driven roller 513 and the driven pressure application roller 523 that make a pair, the pressure distribution can be changed.

In order to prevent the belt pressure from relieving, each roller is arranged so as to fill the shaft intervals as much as possible. Also, from the point of view of the heat transfer, it is preferable that the interval of the rollers that are next to each other is smaller than the circumference length of the roller at the upstream side in the record sheet carrying direction.

Here, considering the point described above, each roller is configured as illustrated in FIG. 6. The roller radius r2 of the auxiliary roller 514 that is adjacent to the drive roller 511 and arranged at the upstream side in the carrying direction of the record sheet of the drive roller 511 is formed to be smaller than the roller radius r1 of the drive roller 511. Similarly, the roller radius r5 of the auxiliary pressure application roller 524 that is adjacent to the pressure application roller 521 and arranged at the upstream side in the carrying direction of the record sheet of the pressure application roller 521 is formed to be smaller than the roller radius r4 of the pressure application roller 521.

The roller radius r1 of the drive roller 511 and the roller radius r4 of the pressure application roller 521 are almost the same.

Similarly, the roller radius r2 of the auxiliary roller 514 and the roller radius r5 of the auxiliary pressure application roller 524 are almost the same. Here, considering a dimensional error of a processing accuracy and the like, "approximately the same" may be within ±10% of one roller radius out of the pair of rollers to form the nip via the fuser belt 510 and the pressure application belt 520. For example, it is $0.9\times r1 \leq r4 \leq 1.1\times r1$.

The roller radius r3 of the driven roller 513 that is adjacent to the auxiliary roller 514 and arranged at the upstream side in the carrying direction of the record sheet of the driven roller 514 is formed to be smaller than the roller radius r1 of the drive roller 511 and almost the same as the roller r2 of the auxiliary roller 514. Here, considering a dimensional error of a processing accuracy and the like, "almost the same" may have a relationship of 0.9×r2≤r3≤1.1×r2.

Similarly, the roller radius r6 of the driven pressure application roller 523 that is adjacent to the auxiliary pressure application roller 524 and arranged at the upstream side in the carrying direction of the record sheet of the auxiliary pressure application roller 524 is formed to be smaller than the roller radius r4 of the pressure application roller 521 and approximately same as the roller radius r5 of the auxiliary pressure application roller 524. Here, considering a dimensional error of a processing accuracy and the like, "almost the same" may have a relationship of 0.9×r5≤r6≤1.1×r5.

When the distance between each shaft 511*a* and 514*a* of the drive roller 511 and the auxiliary roller 514 in the carrying direction of the record sheet is W3, the drive roller 511 and the auxiliary roller 514 are arranged so as to be 2×r1>W3. Also, when the thermal expansion of the roller member by the rise of the temperature inside the device is considered, it is preferable to be 2×r1×1.2>W3. Similarly, when the distance between each shaft 521*a* and 524*a* of the pressure application roller 521 and the auxiliary pressure application roller 524 in the carrying direction of the record sheet is W3', the pressure application roller 521 and the auxiliary pressure application roller 524 are arranged so as to be 2×r4>W3'. Also, when the thermal expansion of the roller member by the rise of the temperature inside the device is considered, it is preferable to be 2×r4×1.2>W3'. W3 and W3', are almost the same. Here, considering a dimensional error of a processing accuracy and the like, "almost the same" may be the relationship of 0.9×W3'≤W3≤1.1×W3'.

The drive roller 511, the driven roller 513, the auxiliary roller 514, the pressure application roller 521, the driven pressure application roller 523, and the auxiliary pressure application roller 524 are formed by covering a shaft of an iron metal core with an elastic layer with a heat-resistant property that consists of a silicone rubber. In the embodiment, the rubber hardness of the elastic layer is ASKER-C75-85°. Also, in order to secure the uniform pressure distribution, the elastic layer may be formed with a low hardness (ASKER-C50-60°) foaming silicone rubber or a further lower hardness (ASKER-C30-40°) liquid silicone rubber.

The both ends of the heater 512 that is disposed inside the fuser belt 510 are supported by the heater support part 535R that is disposed on the bracket 530R and the heater support part 535L disposed on the bracket 530L. As illustrated in FIG. 7 and FIG. 5, the both ends of the heater 522 that is disposed inside the pressure application belt 520 are supported by the heater support part 536R that is disposed on the pressure application roller lever 531R and the heater support part 536L that is disposed on the pressure application roller lever 531L.

At the both sides in the width direction of the fuser belt 510 and the pressure application belt 520, the belt guide 537R and 537L are arranged as regulation members to regulate the twist of the fuser belt 510 and the pressure application belt 520 at the nip area 529 and to manipulate the oblique motion. As illustrated in FIG. 5, the belt guide 537L is positioned by the bracket 530L and fastened by the screw 518. Here, the installation of the belt guide 537L is explained. However, the belt guide 537R that is configured to be the plane symmetry is similarly installed at the bracket 530R.

As illustrated in FIG. 3, in the width direction of the fuser belt 510 and the pressure application belt 520, between the fuser belt 510 and the belt guides 537R, 537L and between the pressure application belt 520 and the belt guides 537R, 537L, the predetermined gap W6 as the belt movable range is disposed so that the belt guides 537R, 537L do not always contact the fuser belt 510 and the pressure application belt 520. In the embodiment, the gap W6 is 2 mm. It is preferred that the gap W6 is within 1 mm to 5 mm. The gap W6 is a margin disposed at the belt guide 537R side in order to reduce a carrying load on the fuser belt 510. The carrying load is created by the belt guide 537 R excessively regulating the movement of the fuser belt 510 in its width direction when the fuser belt 510 is thermally expanded due to an environmental change. Specifically, in FIG. 3, the gap W6 is defined and measured as a gap between the plane 537*a* of the belt guide 537R and a side edge of fuser belt 510 under a condition where the other side edge of the fuser belt 510 contacts the other plane 537*a* of the belt guide 537L. Of course, where the side edge of fuser belt 510 contacts the belt guide 537R, the gap W6 is created at the belt guide 537L side.

FIGS. 10A-10C are configuration views illustrating the form of the belt guide 537L that is illustrated in, for example, FIG. 3. FIG. 10A is the front view, FIG. 10B is the left side view, and FIG. 10C is the top view.

This belt guide 537L is arranged to be perpendicular to the record sheet carrying surface of the fuser belt 510 and the pressure application belt 520 (including the nip area 529) and to be parallel to the carrying direction of the record sheet, and this belt guide 537L has the plane 537*a* (the hatching part) as the belt regulation part to regulate the movement in the belt width direction by regulating the side edges of the fuser belt 510 and the pressure application belt 520. This plane 537*a* is arranged to overlap an upstream area. The upstream area means an area in the upstream side of the sheet carrying direction from a point where the fuser belt 510 and the pressure application belt 520 meets. The point may be defined as a nipping point by the rollers 513 and 523. In FIG. 6, the upstream area is shown at the right side of the rollers 513 and 523.

Here, when the belt guide 537L is positioned on the bracket 530L by the screw 518, the plane 537*a* is formed so as to fill the following condition. As illustrated FIG. 6, it is preferable that the plane 537*a* is formed at the position to face the nip area 529 that is between the rotation center 511*a* of the drive roller 511 and the rotation center 521*a* of the pressure application roller 521 in the direction (the z-axis direction) perpendicular with respect to the nip area 529 that is the carrying surface of the record sheet. In the embodiment, the plane 537*a* is formed between the rotation center 513*a* of the driven roller 513 and the rotation center 523*a* of the driven pressure application roller 523.

As illustrated in FIG. 6, the right edge of the plane 537*a* is formed right to an imaginary connecting line between the two rotation centers 513*a* and 523*a*, and left to point P8 which is the most upstream point of the fuser belt 510 in the carrying direction of the record sheet. In other word, the most upstream edge of the plane 537*a* is located at the downstream side from point P9, and at the upstream side from the nip area 529. Also, the left edge of the plane 537*a* is formed left to an imaginary connecting line between the two rotation centers 511*a* and 521*a*, and right to point P9 which is the most downstream point of the fuser belt 510 in the carrying direction of the record sheet. In other words, the most downstream edge of the plane 537*a* is located at the upstream side from point P9, and at the downstream side from the nip area 529. The plane 537*a* is formed in order to overlap further upstream area from the nip area 529 and further downstream area from the nip area 529. The example range of the plane 537*a* described above is the shaded part in FIG. 6.

In FIG. 10, each slope 537*b*, 537*c*, 537*d*, and 537*e* is the slant part that is adjacent farther outside to the plane 537*a*.

Each of the slopes 537*b*, 537*c*, 537*d*, and 537*e* has a slant in a direction separating from the side edge of the fuser belt 510 and the pressure application belt 520, that is, in a direction in which the plane 537*a* projects. Each of the slopes 537*b*, 537*c*, 537*d*, and 537*e* has a shape that is tapered with θ1, θ2, θ3, and θ4 angle. The taper angles θ1, θ2, θ3, and θ4 are determined considering strength and a twisting amount of belt. The taper angles θ1, θ2, θ3, and θ4 are formed in order not to contact a belt that is twisted to some degree. However, when the belt is twisted more than the degree and contacts the slopes, the slopes function to smoothly guide the belts toward the plane 537*a* so that the twisted state is canceled when the belt returns the plane 537*a*. In the embodiment, the taper angles θ1, θ2, θ3, and θ4 are set 5 degrees. Considering features of conventional fuser belts or pressure application belts, the taper angles θ1, θ2, θ3, and θ4 may be 3 to 7 degrees. It is not necessary for the slopes to be flat. It may be a curved surface. In case of the curved surface, the taper angles can be determined with representative scales of the slopes.

Further, a surface that is adjacent to edges of the plane 537*a*, which is for example a surface 537*f* adjacent to the slope 537*e* and 537*b* in FIGS. 10A and 10C, may be a plane in which each ridge lines with the slopes 537*e* and 537*b* is formed straight shown in FIG. 10A, or in which one inclined ridge line is formed by intersecting the slopes 537*e* and 537*b*. Other parts as well are the same.

Here, when the belt guide 537L is positioned at the bracket 530L by the screw 518, each slope 537*b*, 537*c*, 537*d*, and 537*e* has the following characteristics.

i) The slope 537*e* as a taper at the upstream side in the carrying direction of the record sheet is the surface that extends from the plane 537*a* toward the upstream side in the carrying direction of the record sheet, and as it goes toward the upstream side in the carrying direction of the record sheet, in the belt width direction, the slant part separates more from each side edge of the fuser belt 510 and the pressure application belt 520.

ii) The slope 537*d* as a taper at the downstream side in the carrying direction of the sheet record is the plane that extends from the plane 537*a* toward the downstream side in the carrying direction of the record sheet, and as it goes toward the downstream side in the direction of the record sheet, in the belt width direction, the slant part separates more from each side edge of the fuser belt 510 and the pressure application belt 520.

iii) The slope 537*b* as a taper is the plane that extends from the plane 537*a* and the nip area 529 toward the direction where the drive roller 511 is arranged, as it separates from the nip area 529 in the same direction, in the belt width direction, the slant part separates more from each end of the fuser belt 510 and the pressure application belt 520.

iv) The slope 537*c* as a taper is the plane that extends from the plane 537*a* and the nip area 529 toward the direction where the drive roller 511 is arranged, as it separates from the nip area 529 in the same direction, in the belt width direction, the slant part separates more from each end of the fuser belt 510 and the pressure application belt 520.

Further, on the belt guide 537L, the longhole 541 and the longhole 542 along which shafts of the drive roller 511 and the pressure application roller 521 are allowed to move are formed so that the belt do not contact the belt guide 537L. The longhole 543 along which shafts of the driven roller 513 and the driven pressure application roller 523 are allowed to move, and the longhole 544 along which shafts of the auxiliary roller 514 and the auxiliary pressure application roller 524 are allowed to move are formed so that the belt do not contact the belt guide 537L. On the belt side of each longhole, the chamfering process 550 is chamfered to make the edges smooth. However, instead of the chamfering process 550, they can be chamfered with a rounded corner.

Also, on the belt guide 537L, the concave part 555 with a penetration hole to fasten the screw 518 is formed. When the concave part 555 fixes the screw 518 on the concave part 555, it is formed so that the screw head of the screw 518 does not protrude from the plane 537*a* and each slope 537*b*, 537*c*, 537*d*, and 537*e*.

The belt guide 537L is the part where the fuser belt 510 and the pressure application belt 520 slide, and also it is used at the part where the temperature becomes high that is the fuser part. Therefore the belt guide 537L needs to have a highly slidable and highly heat resistant function, so it is formed by a high performance resin such as PPS, LCP, PEEK, PI, and the like.

Here, the configuration of the belt guide 537L is explained. However, as described above, the belt guide 537R that is configured to be the plane symmetry also has a similar configuration.

In the configuration described above, the movement of the fuser unit 500 in the embodiment is explained.

Accompanied by the print start in the image forming apparatus 1000, the gear 507 for driving that is fixed on the rotation shaft 511*b* of the drive roller 511 rotates in the arrow C direction (FIG. 2) accepting the rotator power from the drive motor (not illustrated). Accompanied by this, the pressure application roller 521, the fuser belt 510, and the pressure application belt 520 are driven and rotated, and further, the driven pressure application roller 523, the driven roller 513, the auxiliary pressure application roller 524, and the auxiliary roller 514 are driven and rotated accompanied by the rotation of the fuser belt 510 and the pressure application belt 520. At this time, the fuser belt 510 and the pressure application belt 520 respectively rotate in the arrow D direction and the arrow E direction illustrated in FIG. 5.

In contrast, the heater 512 (FIG. 5) generates heat because the electric current is supplied from the feeding circuit (not illustrated) and heat the fuser belt 510 from inside. The surface temperature of the fuser belt 510 is detected by the temperature detection means (not illustrated), and based on this detected temperature, it is temperature-controlled to maintain the predetermined fuser temperature by the temperature control part that drives and controls the feeing circuit. Similarly, the heater 522 also generates heat because the electric current is supplied from the feeding circuit (not illustrated) and heat the pressure application belt 520 from inside. The surface temperature of the pressure application belt 520 is detected by the temperature detection means (not illustrated), and based on this detected temperature, it is temperature-controlled to maintain the predetermined fuser temperature by the temperature control part to drive and control the feeing circuit. Additionally, it is possible to control the temperature the temperature control part only arranged at the fuser belt side not at the pressure application belt side.

The record sheet 101 on which the toner image is transferred by the image forming part 400 enters into the nip area 529 of this fuser unit 500 from the upstream side in the carrying direction of the record sheet, it is nipped by the fuser belt 510 that rotates and moves in the arrow D direction and the pressure application belt 520 that rotates and moves in the arrow E direction, and it is carried to the arrow B direction at the nip area 529. Also, during this process, the heat and pressure are applied, and the toner image is melted and fused on the record sheet 101.

In the embodiment, FIGS. 11A and 11B are explanatory views illustrating the positional relation of the drive roller, the right and left belt guide, the fuser belt, and the pressure application roller when the fuser unit is assembled. FIG. 11A is the front view, and FIG. 11B is the top view.

As described above, the nip area 529 (FIG. 5) is formed in the tension free state, so especially the fuser belt 510 and the pressure application belt 520 are not adjusted and installed when the fuser device 500 is assembled. Thereby, as illustrated in FIG. 11, in the fuser belt 510 or/and the pressure application belt 520, the drive roller 511 and the pressure application roller 521, which make the pair, are misaligned more or less because of a manufacturing error, a assembling error, or the like.

FIG. 12-14 are movement explanatory views to explain the movement of the fuser belt 510 and the pressure application belt 520 at an activation time when the rotation of the drive roller 511 starts in the fuser unit 500 illustrated in FIG. 11. In each figure, A is the front view, and B is the top view. Also, each figure of FIG. 12-14 is the partial view in vicinity of the engagement part of the belt guide 537L, the fuser belt 510, and the pressure application belt 520.

As illustrated in FIG. 11, the fuser belt 510 or/and the pressure application belt 520 that make pairs with the drive roller 511 and the pressure application roller 521 (FIG. 5) are misaligned, and when the drive roller 511 is rotated and driven in the predetermined direction, the fuser belt 510 and the pressure application belt 520 respectively start moving so as to balance themselves following the pressure that is generated by the drive roller 511 and the pressure application roller 521 that make pair with the fuser belt 510 and the pressure application belt 520. That is, both side edges of each belt that starts traveling/rotating contact each plane 537*a* (refer to FIGS. 6 and 10) that is disposed on the belt guide 537L and the belt guide 537R, and while each belt moves from side to side, the side edges of the belts are gradually lined up and becomes a state where those are properly aligned. Then, the state is maintained.

FIG. 12 illustrates the state that the fuser 510 and the pressure application belt 520 are misaligned in the opposite directions from each other and they abut on the belt guide. FIG. 13 illustrates the state that the fuser belt 510 and the pressure application belt 520 are aligned. However they move their shafts in the opposite directions from each other and abut on the belt guide. FIG. 14 illustrates the state where the fuser belt 510 and the pressure application belt 520 are in the proper state. The proper state means that they are aligned and both side edges are lightly touched or not touched by each plane 537*a* (refer to FIGS. 6 and 10) disposed on the belt guide 537L and the belt guide 537R while the fuser belt 510 and the pressure application belt 520 travels/rotates.

As described above, the side edge of the fuser belt 510 and the pressure application belt 520 except at the nip area 529 rotates in the free sate when it is not at the nip area 529, so the belt side edge is sometimes twisted as illustrated in FIG. 11. The free part of the belt only has the rigidity itself, so the rigidity is very weak. If the belt side edge of the free part that is in this twisted state contacts the belt guide 537, the contact part will be damaged. Thereby, on the belt guide 537 of the embodiment, the taper (the slope 537*b*, 537*c*, 537*d*, and 537*e*, refer to FIG. 10) is disposed so as to prevent the belt side edge from contacting except at the nip area 529 of the fuser belt 510 and the pressure application belt 520. Therefore, the belt end part of the fuser belt 510 and the pressure application belt 520 contacts the belt guide 537 only at the joining part (the area where the nip area 529 is formed).

In the embodiment, the guide member 537 that has the first roller pair that is configured by the drive roller 511 and the pressure application roller 521, the second roller pair that is configured by the auxiliary roller 514 and the auxiliary pressure application roller 524, and the third roller pair that is configured by the driven roller 513 and the driven pressure application roller 523, and thereby provided with the longholes 541, 542, 543, and 544 as illustrated in FIG. 10 is used. However, it is not limited to this. For example, it can be configured without the second roller pair that is configured by the auxiliary roller 514 and the auxiliary pressure application roller 514. In this case, as illustrated in FIG. 15, the guide member that is not provided with the longhole 544 to escape the second roller pair can be used.

Also, in the embodiment, the example describe that the fuser unit 500 consists of the fuser belt 510 and the pressure application belt 520 that are endless and seamless belts on top and bottom. However, the invention is not limited to this. Using a combination of a top belt and a bottom roller or a combination of a top roller and a bottom belt, or one or more belts can be applicable.

As described above, according to the fuser unit 500 in the embodiment, at the nip area 529, the fuser belt 510 and the pressure application belt 520 are guided and the side edges of them are aligned, and each belt is prevented from contacting the guide member except at the nip area 529. Therefore, the fuser belt 510 and the pressure application belt that form the nip area are properly rotated in the tension free state, and the part of the belt side edge that is freely and unstably rotating does not accept a disturbance from the outside. It is possible to prevent the twisting or waving of the belt and the damage of the belt.

[Scales of Parts]

Using FIGS. 3, 6 and 24, scales (or size) of these parts are to be explained in this section. A thickness T1 of the fuser belt 510 is preferably within 0.05 mm (50 μm) to 0.5 mm (500 μm). In the embodiment, the thickness T1 is 0.15 mm (150 μm). The fuser belt 520 as well may be configured in the same manner. In light of providing the same heat conductivity, or reducing production cost, it is preferred to use identical belts for the fuser belts 510 and 520. The actual height W1 of the fuser belt 510, which is measured when the fuser belt 510 is equipped, is 28.4 mm. The height W2 of the fuser belt 520 is the same as the fuser belt 510.

When a distance from the most upstream point P8 of the fuser belt 510 to the most downstream point of P9 in the medium carrying direction B is defined X, the distance X is 40 mm.

Radiuses r1, r4 of drums 511 and 521 are 6 mm Radiuses r2, r3, r5 and r6 are 4 mm. It is preferred that a ratio of (r1, r4)/(r2, r3, r5, r6) is around 1.5. In view of arranging the drums closer, the ratio (r1, r4)/(r2, r3, r5, r6) may be less than 1.5.

Nip width W4 is 20 mm, a length W10 of the plane 537*a* is 40.3 mm. It is preferred that the length W10 is roughly twice as large as the nip width W4. Lengths W11 and W12 of slopes 537*e*, 537*d* in the medium carrying direction are 6 mm, which are the same. A length W13, which is from the most downstream edge of the nip area to the most downstream edge of the plane 537*a*, is 11.6 mm. A length W14, which is from the most upstream edge of the nip area to the most upstream edge of the plane 537*a*, is 8.7 mm which is smaller than the length W13. Heights H11 and H12 of the slopes 537*b*, 537*c* are 10 mm which are identical. The heights H11 and H12 are not necessarily identical. A height H10 of the plane 537*a* is 6 mm. The nip area is created in the middle of the height H10, thereby two heights H10*a* and H10*b* from the nip are area are both 3 mm. The height H10*a* is at the drive roller 511 side. The height H10*b* is at the pressure application roller 521 side. The heights H10*a* and H10*b* are not necessarily identical. In light of a stable performance with an enough margin, the height H10*a* or H10*b* is preferred to be five times larger than the thickness T1 of the fuser belt 510 and to be 20% or less than the distance W1 (shown in FIG. 6). Also, the heights H11 and H12 are preferably, respectively larger than the heights H10*a* and H10*b*, and ideally at least twice as large as the heights H10*a* and H10*b*.

Upstream edge L81 of plane 537*a* is located at an upstream side from a tangent line L82 that is generated from the most upstream point of the roller 513. The distance E1 between the edge L81 and the tangent line L82 is preferably greater than the height H10*a*. In the embodiment, since the sizes of the rollers 513 and 523 are the same, the tangent line L82 of the roller 513 is the same as that of the roller 523. When the sizes of the rollers 513 and 523 are not the same, a tangent line that is generated from a lager roller is located at an upstream side than the other tangent line that is from a smaller roller. The tangent lines E1 are preferably larger than corresponding heights H10*a* and H10*b*.

Downstream edge L91 of plane 537*a* is located at a downstream side from a tangent line L92 that is generated from the most downstream point of the rollers 511. The distance E2 between the edge L91 and the tangent line L92 is preferably greater than the height H10*a*. In the embodiment, since the sizes of the rollers 511 and 521 are the same, the tangent line L92 of the roller 511 is the same as that of the roller 521. When the sizes of the rollers 511 and 521 are not the same, a tangent line that is generated from a lager roller is located at a downstream side than the other tangent line that is from a smaller roller. The tangent lines E1 are preferably larger than corresponding heights H10*a* and H10*b*.

In the embodiment, considering the size differences between the rollers (511, 521) and the rollers (513, 523), the distance E1 is 4.7 mm, the distance E2 is 5.6 mm which is larger than the distance E1. Considering features of the belts (510, 520), the distance E2 may be larger or smaller than the distance E1 regardless of sizes of the rollers.

With the structure, the fuser belt 510 is securely driven in the nip area W4 between the belt guides 537R and 537L because undesirable movement of the fuser belt 510 (or skewed or twisted in the Y direction which is a front to back side direction of the drawing sheet) is restricted by the planes 537*a* of the belt guides 537R and 537L. In a similar manner, the pressure application belt 520 is also regulated in the Y direction while being driven.

With the gap W6, even when the belts are skewed in the Y-direction or when the environmental temperature changes, the contact period for which the belts (510, 520) contact the belt guides (537R, 537L) is minimized so that the carrying load on the belts maintains low.

As discussed, the fuser belt 510 is driven in the tension free state. Due to lack of tensions in the X direction, the belt 510 is occasionally skewed in the X or Z direction so that the belt 510 contact any parts (537*b* to 537*e*) other than an upper half of the plane 537*a*, which is indicated with H10*a*. In such a case, the slopes (537*b* to 537*e*) guide the belt 510 to the upper half of the plane 537*a* so that the carrying load on the belt 510 maintains low. Similarly, the carrying load on the belt 520 also maintains low by the gap W6 or the slopes (537*b* to 537*e*).

These scales discussed in the first embodiments may be applied to the following embodiment(s).

Second Embodiment

FIG. 16 is an inside configuration view of the fuser unit 600 in the second embodiment based on the present invention viewed from the direction corresponding to the cross section A-A in FIG. 2 as being similar to FIG. 5 in the first embodiment. However, here, the bracket 530L, the pressure application roller lever 531L, and the like are omitted. FIG. 17 is a side view of the fuser unit illustrated in FIG. 16 viewed from the direction of the arrow F.

The point that the image forming apparatus that adopts this fuser unit 600 is mainly different from the image forming apparatus that adopts the fuser unit 500 in the first embodiment illustrated in FIG. 2. Described above is the point that the auxiliary roller 514 and the auxiliary pressure application roller 524 that make a pair (FIG. 5) are omitted and instead, the caster 638 is added on the belt guide 537L. Therefore, in the image forming apparatus that adopts this fuser unit 600, the parts that are in common with the image forming apparatus 1000 in the first embodiment (FIG. 1) are written with the same letters or the explanation is omitted by omitting the figures, and the points that are different are intensively explained. In the second embodiment, the main configuration of the image forming apparatus has the common configuration of the image forming apparatus 1000 in the first embodiment illustrated in FIG. 1 except the fuser unit 600, so the FIG. 1 is referred when it is needed.

FIGS. 18A-18C are configuration views illustrating the form of the belt guide 637L in FIG. 16. FIG. 18A is the front view, FIG. 18B is the right side view, and FIG. 18C is the top view. FIG. 19 is an appearance perspective view of the belt guide 637L in FIG. 16.

On this belt guide 637L, as being similar to the belt guide 537L explained in the first embodiment described above, the plane 537*a*, the slope 537*b*-537*e*, and the longhole 541-534 are formed. Then, along the plane 537*a* that locates between the longholes 541 and 542 that face each other and the long hole 534, the aperture 640 that is slightly wider than this plane 537*a* is formed. In the aperture 640, the roller 638 that has the rotation shaft in the width direction of the plane 537*a* (the direction perpendicular to the carrying surface of the record sheet) and that is rotatably maintained at the back of the aperture 640 by the belt guide 637L is arranged as illustrated in FIG. 18C so that a part of the peripheral surface of the caster 638 slightly protrudes from the plane 537*a*. The width of this caster 638 is set to be slightly narrower than the width of the plane 537*a*.

When this belt guide 637L is positioned on the bracket 537L (FIG. 5) by the screw 518 (FIG. 5), each slope 537*b*, 537*c*, 537*d*, and 537*e* has same characteristics that are similar to the belt guide 537L described in the first embodiment.

Further, here, as illustrated in FIG. 16, the nip area 529 is positioned at the approximately center part of the width of the caster 638. The side edge of the fuser belt 510 or/and the pressure application belt 520 at the nip area 529 moves and contacts the peripheral surface of the caster 638, so the caster 638 is configured so as to rotate. Here, the configuration and the installation of the belt guide 637L are explained. However, as being similar to the first embodiment, the belt guide 637R (not illustrated) that is configured to be the plane symmetry with respect to the virtual plane that perpendicularly crosses at the center of the drive roller 511 and the fuser unit 600 is similarly installed to have a similar configuration.

In the configuration above, the movement of the fuser unit 600 in the embodiment is explained.

Accompanied by the print start in the image forming apparatus, when the drive roller 511 rotates in the arrow C direction (FIG. 16) accepting the rotator power from the drive motor (not illustrated), accompanied by this, the fuser belt 510 and the pressure application belt 520 respectively rotate in the arrow D direction and the arrow E direction illustrated in FIG. 16. At this time, the fuser belt 510 or/and the pressure application belt 520 respectively start to move so as to balance themselves following the pressure generated by the drive roller 511 and the pressure application roller 521 that make a pair.

Namely, when the belt that starts traveling/rotating, each side edge of the belt contacts casters 638 that are disposed on the belt guides 637L and 637R. While the belts moves from side to side, the end parts of the belt are gradually lined up and become the state where they are properly aligned. That is, the drive roller 511 and the pressure application roller 521 are aligned, and also, the end part of them moves such that the side edge is lightly touched or not touched on the caster 638 that is disposed on the belt guide 537L and the belt guide 537R. Once the alignment is sent properly. The state is maintained.

In the embodiment, as the example, one caster 638 corresponding to an end part of the belt in the nip area is arranged. However, the present invention is not limited to this. For example, as illustrated in FIG. 20 and FIG. 21, along the nip area 529, a plurality of the casters 738 (here two) may be arranged.

FIGS. 22A-22C are configuration views illustrating the form of the belt guide 737L in FIG. 20. FIG. 22A is the front view, FIG. 22B is the left side view, and FIG. 22C is the top view. FIG. 23 is an appearance perspective view of the belt guide 737L in FIG. 20.

On this belt guide 737L, the plane 537*a*, the slopes 537*b*-537*e*, and the longholes 541-543 are formed as being same as the belt guide 537L (FIG. 10) explained in the first embodiment described above. Then, along the plane 537*a* that locates between the longholes 541 and 542 that face each other, the aperture 640 that is lightly wider than this plane 537*a* is formed. In this aperture 640, two rollers 738 that have the rotation shafts in the width direction of the plane 537*a* (the direction perpendicular to the carrying direction of the record sheet) and that are rotatably maintained at the back of the aperture 640 by the belt guide 737L are arranged side by side in the carrying direction of the record sheet so that a part of the peripheral surface of the caster 738 slightly protrudes from the plane 537*a*. The width of this caster 738 is set to be slightly narrower than the width of the plane 537*a*.

As described above, according to the fuser unit of the embodiment, at the nip area 529, the fuser belt 510 and the pressure application belt 520 are guided by the caster 638 (738) and the side edge of each belt is lined up, and also, each belt is prevented from contacting the guide member except at the nip area. Therefore, the fuser belt 510 and the pressure application belt 520 that form the nip area in the tension free state are properly rotated, and also, the part of the belt side edge that is freely and unstably rotating does not accept a disturbance from the outside, so it is possible to prevent the twist or waving of the belt and the damage of the belt.

Further, according to the fuser unit of the embodiment, by the caster 638 (738), the side edge of each belt is guided while controlling the generation of the friction, so the damage to the belt is reduced and the belt life span becomes longer, and it is possible for the belt carrying to be stabilized for a long time.

INDUSTRIAL USABILITY

In the embodiment described above, the fuser unit of the color electrographic printer is explained as the example for the present invention. However, it can be used for the fuser device of the image forming apparatus that can copy color, single color, or monochrome, such as a copy machine, a facsimile, a printer, a multifunction machine.

What is claimed is:

1. A fuser device for fusing a developer image on a medium by applying heat and pressure, comprising:

a belt part that has an endless shape and that is configured to rotate in a tension free state to carry the medium in a medium carrying direction;

a first nip forming part that is arranged inside the belt part;

a second nip forming part that is arranged to face the first nip forming part, and configured to apply a pressure toward the first nip forming part, sandwiching the belt part with the first nip forming part so that a nip area is formed therebetween, the developer image on the medium being fused during passing the nip area; and a regulation member that regulates a movement of the belt part in a width direction of the belt part, wherein the regulation member is configured with a belt regulation part and a slant part, the belt regulation part has a flat shape that is arranged near one of side edges of the belt part along the nip area with a predetermined gap (W6) in the width direction of the belt part, the slant part extends from an edge of the belt regulation part, the first nip forming part is a first roller that drives the belt part, the second nip forming part is a second roller that applies a pressure toward the first roller, the belt part is configured with a first belt part and a second belt part each of which has an endless shape, the first belt part has the first roller arranged therein, the second belt part, in which the second roller is arranged, is sandwiched between the first belt part and the second roller so that the medium is carried therebetween, further comprising:

a third roller that is arranged inside the first belt part and at the upstream side from the first roller, a fourth roller that is arranged inside the second belt part and to face the third roller sandwiching the first belt part and the second belt part, and the nip area is formed in a region defined by a pair of the first and second rollers and another pair of the third and fourth rollers in the medium carrying direction.

2. The fuser device according to claim 1, further comprising:

another regulation member that is identical to the regulation member, wherein the another regulation member is arranged near the other of side edges of the belt part along the nip area with the predetermined gap (W6).

3. The fuser device according to claim 1, wherein, the belt regulation part is positioned between a center of the first roller and a center of the second roller in a direction perpendicular to the medium carrying direction and the width direction of the belt part.

4. The fuser device according to claim 1, wherein the slant part is a slope that extends from an upstream edge of the belt regulation part toward an upstream side in the medium carrying direction, the slope is inclined such that it separates farther from the side edge of the belt part in the width direction of the belt part as the slope goes toward the upstream side of the medium carrying direction.

5. The fuser device according to claim 1, wherein the slant part is a slope that extends from a downstream edge of the belt regulation part toward a downstream side in the medium carrying direction, the slope is inclined such that it separates farther from the side edge of the belt part in the width direction of the belt part as the slope goes toward the downstream side of the medium carrying direction.

6. The fuser device according to claim 1, wherein the slant part is a slope that extends from a side edge of the belt regulation part at the first nip forming part side in a direction perpendicular to a surface of the belt part, the slope is inclined such that it separates farther from the side edge of the belt part in the width direction of the belt part as the slope goes farther from the nip area.

7. The fuser device according to claim 1, wherein the slant part is a slope that extends from a side edge of the belt regulation part at the second nip forming part side in a direction perpendicular to a surface of the belt part, the slope is inclined such that it separates farther from the side edge of the belt part in the width direction of the belt part as the slope goes farther from the nip area.

8. The fuser device according to claim 1, further comprising:

a fifth roller that is arranged inside the first belt part and between the first roller and the third roller, and a sixth roller that is arranged inside the second belt part and between the second roller and the forth roller to face the fifth roller sandwiching the first and second belt parts with the fifth roller.

9. The fuser device according to claim 1, wherein the belt regulation part has a length longer than a length of the nip area in the medium carrying direction, and an upstream edge of the belt regulation part is at a farther upstream side than the nip area, a downstream edge of the belt regulation part is at a farther downstream side than the nip area.

10. The fuser device according to claim 1, wherein the second belt part is configured to travel in a tension free state.

11. The fuser device according to claim 1, further comprising:

a caster that is arranged in the belt regulation part, of which a rotational shaft being oriented in a direction perpendicular to a surface of the belt part, and of which a perimeter rotates around the shaft, wherein the caster is projected toward the nip area from the belt regulation part in order to slightly contact the side edge of the belt part.

12. An image forming apparatus, comprising:

a medium feeding part that feeds a medium;

an image forming part that creates a developer image on the medium; and the fuser device according to claim 1 that fuses the developer image on the medium.

13. A fuser device for fusing a developer image on a medium by applying heat and pressure, comprising:

a belt part that has an endless shape and that is configured to rotate in a tension free state to carry the medium in a medium carrying direction;

a first nip forming part that is arranged inside the belt part;

a second nip forming part that is arranged outside the belt part to face the first nip forming part, and configured to apply a pressure toward the first nip forming part, sandwiching the belt part with the first nip forming part so that a nip area is formed therebetween, the developer image on the medium being fused during passing the nip area; and a regulation member that regulates a movement of the belt part in a width direction of the belt part, wherein the regulation member is configured with a belt regulation part and a slant part, the belt regulation part has a flat shape that is arranged near one of side edges of the belt part along the nip area with a predetermined gap (W6) in the width direction of the belt part, the slant part that is inclined with respect to the flat shape of the belt regulation part, is connected to an edge of the belt regulation part, and is positioned outside the belt part in the width direction of the belt part.

14. The fuser device according to claim 13, wherein the slant part is a slope that extends from an upstream edge of the belt regulation part toward an upstream side in the medium carrying direction, the slope is inclined such that it separates farther from the side edge of the belt part in the width direction of the belt part as the slope goes toward the upstream side of the medium carrying direction.

15. The fuser device according to claim 13, wherein the slant part is a slope that extends from a downstream edge of the belt regulation part toward a downstream side in the medium carrying direction, the slope is inclined such that it separates farther from the side edge of the belt part in the width direction of the belt part as the slope goes toward the downstream side of the medium carrying direction.

16. The fuser device according to claim 13, wherein the slant part is a slope that extends from a side edge of the belt regulation part at the first nip forming part side in a direction perpendicular to a surface of the belt part, the slope is inclined such that it separates farther from the side edge of the belt part in the width direction of the belt part as the slope goes farther from the nip area.

17. The fuser device according to claim 13, wherein the slant part is a slope that extends from a side edge of the belt regulation part at the second nip forming part side in a direction perpendicular to a surface of the belt part, the slope is inclined such that it separates farther from the side edge of the belt part in the width direction of the belt part as the slope goes farther from the nip area.

* * * * *